US012359452B1

(12) United States Patent
MacKarvich et al.

(10) Patent No.: US 12,359,452 B1
(45) Date of Patent: Jul. 15, 2025

(54) FALL PROTECTION SYSTEM AND GUARDRAIL POST ASSEMBLY THEREFOR

(71) Applicant: Tie Down, Inc., Atlanta, GA (US)

(72) Inventors: Charles J. MacKarvich, Atlanta, GA (US); Mohammed Aamir, Atlanta, GA (US)

(73) Assignee: Tie Down, Inc., Atlanta, GA (US)

( * ) Notice: Subject to any disclaimer, the term of this patent is extended or adjusted under 35 U.S.C. 154(b) by 0 days.

(21) Appl. No.: 18/955,232

(22) Filed: Nov. 21, 2024

Related U.S. Application Data

(60) Provisional application No. 63/619,187, filed on Jan. 9, 2024.

(51) Int. Cl.
*E04G 21/32* (2006.01)

(52) U.S. Cl.
CPC ..... *E04G 21/3233* (2013.01)

(58) Field of Classification Search
CPC . E04G 21/32; E04G 21/3219; E04G 21/3233; E01F 15/146; E01F 13/028; E01F 13/048; E01F 13/022; E04F 11/1859
See application file for complete search history.

(56) References Cited

U.S. PATENT DOCUMENTS

| | | | |
|---|---|---|---|
| 346,644 | A | 8/1886 | Crisp |
| 361,001 | A | 4/1887 | Devens |
| 362,911 | A | 5/1887 | Vanover |
| 380,627 | A | 4/1888 | Harmon et al. |
| 406,642 | A | 7/1889 | Frost |
| 412,766 | A | 10/1889 | Lounsberry |
| 432,930 | A | 7/1890 | Bond |
| 448,030 | A | 3/1891 | Harnish |
| 511,378 | A | 12/1893 | Van Wagoner |
| 533,334 | A | 1/1895 | Yakley |
| 572,719 | A | 12/1896 | Reppeto et al. |
| 583,785 | A | 6/1897 | Brown |
| 589,898 | A | 9/1897 | Johnston |

(Continued)

FOREIGN PATENT DOCUMENTS

| | | | |
|---|---|---|---|
| CA | 2651731 | A1 | 7/2010 |
| CA | 2802581 | C | 7/2015 |

(Continued)

OTHER PUBLICATIONS

Corrected Notice of Allowance for U.S. Appl. No. 18/370,715, dated Nov. 18, 2024, 2 Pages.

(Continued)

*Primary Examiner* — Daniel J Wiley
(74) *Attorney, Agent, or Firm* — Buchalter, a Professional Corporation

(57) ABSTRACT

A guardrail post assembly includes a post frame defining a first lateral side and a second lateral side opposite the first lateral side; a first guardrail strap mounted proximate to the first lateral side; a second guardrail strap mounted proximate to the second lateral side, the first guardrail strap and the second guardrail strap mounted at equal heights on the guardrail post assembly; and a guardrail attachment assembly mounted to the post frame, the guardrail attachment assembly comprising a strap mounting portion and locking portion, the first guardrail strap mounted on the strap mounting portion.

38 Claims, 15 Drawing Sheets

(56) References Cited

U.S. PATENT DOCUMENTS 603,157 A 4/1898 Spitzenberg
613,078 A 10/1898 Robbns
636,855 A 11/1899 Sawyer
759,344 A 5/1904 Carolan
776,624 A 12/1904 Steward
793,371 A 6/1905 Hansberger
858,345 A 6/1907 Kaufman
866,195 A 9/1907 Dillman et al.
869,231 A 10/1907 Colvin
965,692 A 7/1910 Culp
981,562 A 1/1911 Holladay et al.
997,725 A 7/1911 Wilson
1,004,308 A 9/1911 Stidworthy
1,036,447 A 8/1912 Bushnell
1,044,921 A 11/1912 Schneider
1,050,589 A 1/1913 Young
1,161,704 A 11/1915 Ljeso
1,199,583 A 9/1916 McConnohie
1,204,942 A 11/1916 Clanton et al.
1,323,144 A 11/1919 Alig
1,599,928 A 9/1926 Sweeney
1,742,838 A 1/1930 Williams
1,793,106 A 2/1931 Lindemuth
1,804,420 A 5/1931 Kelley
1,814,664 A 7/1931 Cahill et al.
1,848,527 A 3/1932 Hickey
2,065,562 A 12/1936 Brown
2,139,642 A 12/1938 Alfred
2,168,954 A 8/1939 Jacob et al.
2,222,249 A 11/1940 Borgen
2,227,553 A 1/1941 Paque
2,306,661 A 12/1942 Gengler
2,351,261 A 6/1944 Hall
2,369,225 A 2/1945 George
2,431,431 A 11/1947 Shenk
2,470,318 A 5/1949 Samuel
2,515,615 A 7/1950 Tetzlaff
2,573,239 A 10/1951 Barrett
2,895,716 A 7/1959 Veltri
3,684,248 A 8/1972 Maes, Jr.
3,880,405 A * 4/1975 Brueske ..... E04G 21/3285 248/237
4,040,604 A 8/1977 Langlie et al.
D245,792 S 9/1977 Dougherty
4,058,882 A 11/1977 Muckelrath
4,185,360 A 1/1980 Prete, Jr. et al.
4,268,012 A 5/1981 Ruehle et al.
D260,855 S 9/1981 Hobson
4,341,029 A 7/1982 Heard
4,409,907 A 10/1983 Norton
4,433,831 A 2/1984 Bunger
4,475,854 A 10/1984 Ericsson
4,493,480 A 1/1985 Nichol
4,604,773 A 8/1986 Weber et al.
4,782,915 A 11/1988 King
4,786,223 A 11/1988 Crissy et al.
4,787,602 A 11/1988 Pidgeon
4,823,443 A 4/1989 Waters
4,879,800 A 11/1989 Rumman
4,900,203 A 2/1990 Pope
4,913,608 A 4/1990 Royball
4,932,634 A 6/1990 Sura
5,090,397 A 2/1992 Larsen et al.
5,165,499 A * 11/1992 Bell ..... E04G 21/3261 182/9
5,245,729 A 9/1993 Greff
5,282,706 A 2/1994 Anthony et al.
5,307,897 A * 5/1994 Turner ..... E04G 21/3261 182/113
5,319,870 A 6/1994 Weiss
5,350,155 A 9/1994 Burk
5,632,461 A 5/1997 Von Helms et al.
5,655,623 A 8/1997 Skyba
5,727,648 A 3/1998 Jenkins, Jr.
5,816,362 A 10/1998 Jenkins, Jr.
6,007,053 A 12/1999 Huang
6,021,702 A 2/2000 Rexroad
6,029,556 A 2/2000 Rexroad
6,158,092 A 12/2000 Huang
6,202,964 B1 3/2001 Thornhill
6,241,174 B1 6/2001 Nelsen et al.
6,290,195 B1 9/2001 Deuer
6,547,218 B2 4/2003 Landy
6,665,910 B2 12/2003 Huang
6,681,892 B2 1/2004 Husband
6,705,597 B1 3/2004 Reilly et al.
6,779,630 B2 8/2004 Choate
6,840,194 B2 1/2005 Young
6,978,737 B2 12/2005 Kirch et al.
7,080,967 B2 7/2006 Ackerman et al.
7,140,802 B2 11/2006 Lamore
7,350,767 B2 4/2008 Huang
7,360,753 B1 4/2008 Lin
7,448,596 B1 11/2008 Chang
D590,068 S 4/2009 Woller
7,566,047 B2 7/2009 Wall
7,571,567 B2 8/2009 Bortolussi
7,617,963 B1 11/2009 Jensen
7,651,072 B1 1/2010 Chang
7,690,481 B1 4/2010 Pederson
7,845,621 B1 12/2010 Lu
7,874,047 B2 1/2011 Breeden
7,942,602 B2 5/2011 Bunk et al.
8,398,040 B2 3/2013 Busch
8,424,641 B2 4/2013 Pandazopoulos et al.
8,424,852 B2 * 4/2013 Anson ..... E04G 21/3219 256/45
8,561,952 B2 10/2013 Pfeiler
8,632,056 B1 1/2014 Roberts et al.
D709,361 S 7/2014 Caldwell
8,814,145 B2 8/2014 Herman
8,925,904 B2 1/2015 Christoffer et al.
9,156,507 B1 10/2015 Reed
9,567,768 B1 2/2017 Galla
D852,614 S 7/2019 Schloss
D852,615 S 7/2019 Schloss
10,456,612 B2 10/2019 McGhee
10,689,866 B2 6/2020 Baca et al.
10,793,052 B1 10/2020 Rafuse
10,814,774 B2 10/2020 Millett et al.
10,836,299 B2 11/2020 Hatcher
10,857,930 B1 12/2020 Levi
D909,860 S 2/2021 Johnston et al.
10,988,071 B2 4/2021 Kingery
D925,348 S 7/2021 Norfleet et al.
11,198,038 B1 12/2021 Power, II et al.
11,753,836 B2 * 9/2023 MacKarvich ..... E04F 11/1859 256/59
11,795,713 B2 * 10/2023 MacKarvich ..... E04G 21/3233
D1,015,865 S 2/2024 Mackarvich
12,173,519 B2 * 12/2024 MacKarvich ..... E04G 21/3219
2002/0063248 A1 5/2002 Siegler et al.
2002/0096396 A1 7/2002 Harmston
2003/0098202 A1 5/2003 Husband
2004/0135134 A1 * 7/2004 Rice ..... E04G 21/3223 256/32
2004/0216952 A1 * 11/2004 Woller ..... A01M 31/00 182/100
2006/0180800 A1 8/2006 Tremblay
2006/0197001 A1 9/2006 Parker et al.
2006/0197071 A1 9/2006 Huang
2007/0034165 A1 2/2007 Yang
2007/0176401 A1 * 8/2007 Adshead ..... E04G 21/24 280/733
2008/0173854 A1 7/2008 Meaux et al.
2010/0301297 A1 12/2010 Chapman
2013/0075556 A1 3/2013 Pfeiler
2014/0102829 A1 4/2014 Stearns et al.
2016/0250961 A1 9/2016 Tolly et al.
2016/0347233 A1 12/2016 Kingery
2018/0340343 A1 11/2018 Carpenter
2019/0143159 A1 5/2019 Grant
2019/0381929 A1 12/2019 Millett et al.
2021/0238872 A1 8/2021 Brim, III et al.

(56) References Cited

U.S. PATENT DOCUMENTS

| | | | | |
|---|---|---|---|---|
| 2023/0060153 | A1 | 3/2023 | Lowrey | |
| 2023/0228108 | A1* | 7/2023 | MacKarvich ..... | E04G 21/3233 256/59 |
| 2023/0228109 | A1* | 7/2023 | MacKarvich ..... | E04G 21/3219 256/59 |
| 2023/0399863 | A1 | 12/2023 | Mackarvich et al. | |
| 2024/0011310 | A1 | 1/2024 | Mackarvich et al. | |
| 2025/0059786 | A1 | 2/2025 | MacKarvich et al. | |
| 2025/0153312 | A1 | 5/2025 | MacKarvich | |

FOREIGN PATENT DOCUMENTS

| | | | |
|---|---|---|---|
| DE | 102010025513 | A1 | 12/2011 |
| DE | 202018100633 | U1 | 2/2019 |
| WO | 2010085872 | A1 | 8/2010 |

OTHER PUBLICATIONS

Extended European Search Report for European Application No. 22215180.5, dated May 23, 2023, 7 pages.
Extended European Search Report for European Application No. 23165454.2, dated Feb. 15, 2024, 6 pages.
Final Office Action for U.S. Appl. No. 17/578,295, dated Sep. 7, 2022, 20 pages.
Final Office Action for U.S. Appl. No. 18/227,199, dated Feb. 12, 2024, 37 pages.
Final Office Action for U.S. Appl. No. 18/370,715, dated Feb. 22, 2024, 44 pages.
Notice of Allowance for U.S. Appl. No. 18/227,199, filed Jul. 27, 2023, mailed Oct. 23, 2024, 10 pgs.
Non-Final Office Action for U.S. Appl. No. 17/578,295, dated Jan. 5, 2023, 22 pages.
Non-Final Office Action for U.S. Appl. No. 17/578,295, dated May 31, 2022, 18 pages.
Non-Final Office Action for U.S. Appl. No. 17/953,235, dated Mar. 2, 2023, 30 pages.
Non-Final Office Action for U.S. Appl. No. 18/227,199, dated Jun. 14, 2024, 26 pages.
Non-Final Office Action for U.S. Appl. No. 18/227,199, dated Oct. 4, 2023, 25 pages.
Non-Final Office Action for U.S. Appl. No. 18/370,715, dated Jun. 17, 2024, 21 pages.
Non-Final Office Action for U.S. Appl. No. 18/370,715, dated Nov. 21, 2023, 16 pages.
Non-Final Office Action for U.S. Appl. No. 29/868,602, dated Apr. 13, 2023, 14 pages.
Notice of Allowance for U.S. Appl. No. 17/578,295, dated May 1, 2023, 16 pages.
Notice of Allowance for U.S. Appl. No. 17/953,235, dated Jun. 21, 2023, 23 pages.
Notice of Allowance for U.S. Appl. No. 29/868,602, dated Sep. 1, 2023, 13 pages.
Requirement for Restriction/Election for U.S. Appl. No. 17/578,295, dated Apr. 12, 2022, 7 pages.
Notice of Allowance for U.S. Appl. No. 18/370,715, filed Sep. 20, 2023, mailed Oct. 23, 2024, 9 pgs.
Non-Final Office Action for U.S. Appl. No. 18/929,242, dated Dec. 27, 2024, 34 pages.
Invitation to Pay Additional Fees for International Application No. PCT/US2024/061212, dated Feb. 13, 2025, 2 pages.
Corrected Notice of Allowance for U.S. Appl. No. 18/227,199, dated Dec. 13, 2024, 6 pages.
Communication pursuant to Article 94(3) EPC for European Application No. 23165454.2, dated Mar. 26, 2025, 4 pages.
Corrected Notice of Allowance for U.S. Appl. No. 18/929,242, dated Mar. 12, 2025, 3 pages.
International Search Report and Written Opinion for International Application No. PCT/US2024/061212, mailed Apr. 10, 2025, 22 Pages.
Notice of Allowance for U.S. Appl. No. 18/929,242, dated Feb. 27, 2025, 8 pages.

* cited by examiner

FALL PROTECTION SYSTEM AND GUARDRAIL POST ASSEMBLY THEREFOR

CROSS-REFERENCE TO RELATED APPLICATIONS

The present application claims the benefit of U.S. Provisional Application No. 63/619,187, filed Jan. 9, 2024, which is hereby specifically incorporated by reference herein in its entirety.

TECHNICAL FIELD

This disclosure relates to building construction. More specifically, this disclosure relates to a fall protection system for use on an elevated surface.

BACKGROUND

Building structures under construction often have elevated surfaces, such as elevated floor slabs, that require guardrails or other safety measures to prevent accidental falls. Guardrails are typically placed at a perimeter of the elevated surface and are secured to structural components of the building structure, such as pillars. However, guardrail systems frequently are unable to adapt pillars of varying sizes and shapes. Additionally, guardrails that are not properly secured or suitably taut can move and can fail to prevent falls from the elevated surface.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a guardrail post assembly comprising a post frame; a guardrail attachment assembly mounted to the post frame and configurable in a disengaged configuration and an engaged configuration, the guardrail attachment assembly comprising: a strap mounting portion comprising a worm wheel; and a locking portion comprising a worm gear; and a guardrail strap mounted to the strap mounting portion of the guardrail attachment assembly; wherein, in the disengaged configuration, the worm gear is disengaged from the worm wheel, and in the engaged configuration, the worm gear is engaged with the worm wheel.

Also disclosed is a guardrail post assembly comprising a post frame defining a first lateral side and a second lateral side opposite the first lateral side; a first guardrail strap mounted proximate to the first lateral side; a second guardrail strap mounted proximate to the second lateral side, the first guardrail strap and the second guardrail strap mounted at equal heights on the guardrail post assembly; and a guardrail attachment assembly mounted to the post frame, the guardrail attachment assembly comprising a strap mounting portion and locking portion, the first guardrail strap mounted on the strap mounting portion.

Additionally, disclosed is a guardrail post assembly comprising a post frame comprising a substantially vertical mounting post; a pillar attachment assembly comprising: a pillar attachment chain configured to wrap around a pillar; and a pillar attachment device mounted to the substantially vertical mounting post, the pillar attachment device comprising a chain attachment bracket and a bracket fastener threadedly engaging the chain attachment bracket, wherein the bracket fastener is rotatable relative to the chain attachment bracket to selectively tighten or loosen the pillar attachment chain around the pillar; a guardrail attachment assembly mounted to the post frame; and a guardrail strap mounted to the guardrail attachment assembly.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
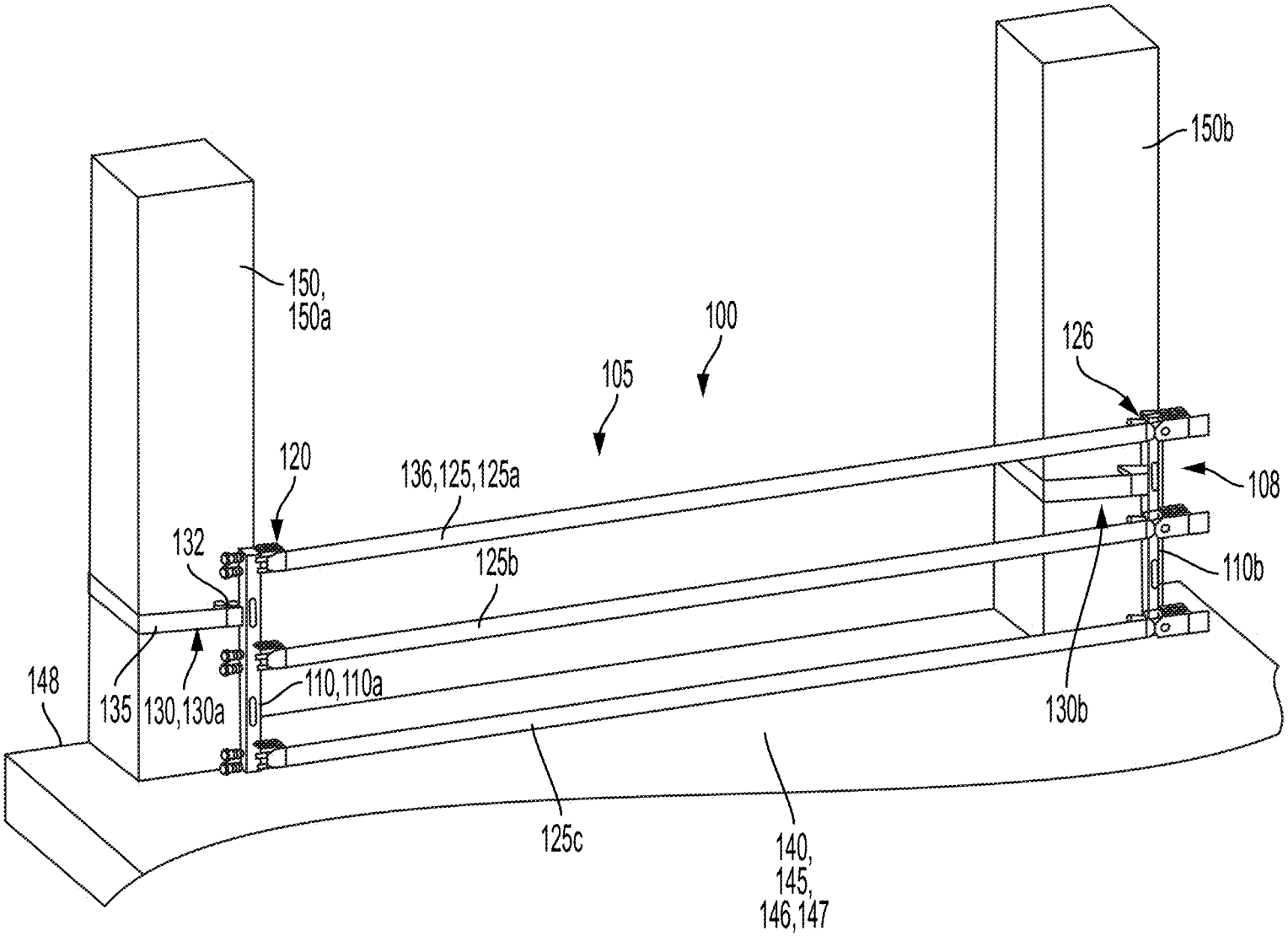
FIG. 1 is a front perspective view of a fall protection system, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a guardrail post assembly for a fall protection system and associated methods, systems, devices, and various apparatus. Example aspects of the guardrail post assembly can comprise a guardrail post, a guardrail, and a guardrail attachment assembly for attaching the guardrail to the guardrail post. It would be understood by one of skill in the art that the guardrail post assembly is described in but a few exemplary embodiments among many. No particular terminology or description should be considered limiting on the disclosure or the scope of any claims issuing therefrom.

FIG. 1 is a front perspective view of a fall protection system 100, in accordance with one aspect of the present disclosure. The fall protection system 100 can be secured to a structural component of a structure, such as a building structure 140 under construction, to prevent accidental falls from an elevated slab 145 or elevated surface of the building structure 140. The structural component can be a substantially vertical pillar 150, for example and without limitation. The substantially vertical pillar 150 can define a substantially square or rectangular cross-sectional shape, as shown, or can define any other suitable cross-sectional shape, including but not limited to circular, triangular, etc. In the present aspect, the building structure 140 can comprise the elevated slab 145 and at least one of the substantially vertical pillars 150 extending upward therefrom, and the fall protection system 100 can be coupled to the at least one pillar 150.

According to example aspects, the elevated slab 145 can be, for example, an elevated floor slab 146. Elevated floor slabs 146 can be found in a commercial building, for example and without limitation, such as high-rise offices and hotels. The pillars 150 can extend substantially vertically between the elevated floor slab 146 and an elevated ceiling slab, to support the elevated ceiling slab above the elevated floor slab 146. Example aspects of the elevated floor slab 146 can comprise concrete or any other suitable material. The elevated floor slab 146 can be oriented substantially horizontally and can define an upper floor surface 147 from which the pillars 150 can extend. The elevated floor slab 146 can further define a peripheral edge 148, and the fall protection system 100 can be mounted to pillars 150 at or near the peripheral edge 148. Thus, an upright boundary 105 formed by the fall protection system 100 can prevent accidental falls off the elevated slab 145 at the peripheral edge 148 thereof. In some aspects, the fall protection system 100 can extend fully along or around the peripheral edge 148 of the elevated slab 145. However, in other aspects, the fall protection system 100 may extend only partially along or around the peripheral edge 148.

In the present aspect, the at least one pillar 150 can comprise a first pillar 150*a* and a second pillar 150*b*, and the fall protection system 100 can be coupled to and can extend between the first and second pillars 150*a,b*. In other aspects, the building structure 140 can comprise more or fewer pillars 150. For example, the building structure 140 may comprise additional pillars 150 and the fall protection system 100 can be coupled to and can extend between the additional pillars 150. Example aspects of such a fall protection system 100 are further disclosed in U.S. Pat. No. 11,753,836, issued on Sep. 12, 2023, and U.S. Pat. No. 11,795,713, issued on Oct. 24, 2023, each of which is hereby specifically incorporated by reference herein in its entirety.

Example aspects of the fall protection system 100 can comprise a guardrail support frame 108. The guardrail support frame 108 can comprise at least one substantially vertical guardrail post assembly 110. Each of the guardrail post assemblies 110 can be secured to a corresponding one of the vertical pillars 150. For example, in the present aspect, the guardrail post assemblies 110 can comprise at least a first guardrail post assembly 110*a* secured to the first pillar 150*a* and a second guardrail post assembly 110*b* secured to the second pillar 150*b*. In other aspects, the fall protection system 100 can comprise more or fewer guardrail post assemblies 110. For example, the fall protection system 100 may comprise additional guardrail post assemblies 110, each of which can be secured to an additional pillar 150.

The fall protection system 100 can further comprising one or more lateral safety guardrails 125 supported by the guardrail support frame 108. In the present aspect, the lateral safety guardrails 125 can extend laterally between the first and second guardrail post assemblies 110*a,b*, and thus, can extend between the first and second pillars 150*a,b*. The lateral safety guardrails 125 can be oriented about horizontally, as shown in the present aspect, or can be oriented at an acute angle relative to horizontal. In the present aspect, each of the lateral safety guardrails 125 can be formed as a flexible guardrail strap 125. In other aspects, the lateral safety guardrails 125 can be semi-rigid or rigid.

In the present aspect, the guardrail straps 125 can comprise at least a first upper guardrail strap 125*a*, a first lower guardrail strap 125*c*, and a first middle guardrail strap 125*b* disposed between the first upper and lower guardrail straps 125*a,c*. In example aspects, the first lower guardrail strap 125*c* can extend along and can touch or nearly touch the upper floor surface 147. The first lower guardrail strap 125*c* can define a height suitable to prevent loose objects (e.g., paint cans, tools, etc.) from rolling or sliding past the first lower guardrail strap 125*c* and falling over the peripheral edge 148 of the elevated slab 145. Other aspects of the fall protection system 100 can comprise more or fewer of the guardrail straps 125 extending between the first and second guardrail post assemblies 110*a,b*. Example aspects of the guardrail straps 125 can comprise a plastic material, such as, for example, nylon webbing. In other aspects, the guardrail straps 125 can comprise any other suitable material known in the art. In some aspects, the guardrail straps 125 can be inelastic or semi-inelastic, while in other aspects, the guardrail straps 125 can be elastic. Additionally, in example aspects, a length of each guardrail strap 125 can be sized to accommodate varying distances between the first and second guardrail post assemblies 110*a,b*.

Example aspects of the guardrail support frame 108 can further comprise one or more substantially vertical reinforcement post assemblies arranged between the adjacent guardrail post assemblies 110 (e.g., the first and second guardrail post assemblies 110*a,b*) and coupled to each of the guardrail straps 125. The reinforcement post assemblies can be freestanding (i.e., not attached to the building structure 140) and can provide reinforcement to the guardrail straps 125 between the adjacent guardrail post assemblies 110, which can be beneficial in building structures 140 wherein a significant distance is defined between adjacent pillars 150. Example aspects of such reinforcement post assemblies are disclosed in disclosed in U.S. Pat. No. 11,753,836, issued on Sep. 12, 2023, and U.S. Pat. No. 11,795,713, issued on Oct. 24, 2023, both previously incorporated by reference, and in U.S. Provisional Application No. 63/598,777, filed Nov. 14, 2023, each of which is hereby specifically incorporated by reference herein in its entirety.

According to example aspects, each of the guardrail straps 125 can be mounted to the first guardrail post assembly 110*a* by a corresponding guardrail attachment assembly 120. The guardrail attachment assemblies 120 can be vertically spaced along a length of the first guardrail post assembly 110*a*, as shown. In example aspects, each of the guardrail straps 125 can be rolled up on the corresponding guardrail attachment assembly 120. To extend each of the guardrail straps 125 from the first guardrail post assembly 110*a* to the second guardrail post assembly 110*b*, the guardrail strap 125 can be unrolled or partially unrolled by pulling a free end 126 of the guardrail strap 125 towards the second guardrail post assembly 110*b*. The free end 126 can be releasably secured to the second guardrail post assembly 110*b* and the guardrail strap 125 can be held taut between the first and second guardrail post assemblies 110*a,b*, as described in further detail below. With the guardrail straps 125 extended between the first and second guardrail post assemblies 110*a,b*, the fall protection system 100 can define the substantially upright boundary 105 between the first and second pillars 150*a,b*, as shown. In other aspects, the free end 126 of each guardrail strap 125 can be releasably secured to any other suitable post assembly of the guardrail support frame 108, such as one of the reinforcement post assemblies for example and without limitation.

Example aspects of the fall protection system 100 can further comprise one or more pillar attachment assemblies 130. Each of the pillar attachment assemblies 130 can be configured to couple a corresponding one of the guardrail post assemblies 110 to the corresponding vertical pillar 150. Securing the upright boundary 105 to the vertical pillars 150 can prevent movement thereof and ensure safe and proper functioning of the fall protection system 100. For example, the pillar attachment assemblies 130 can comprise a first pillar attachment assembly 130*a* coupling the first guardrail post assembly 110*a* to the first pillar 150*a* and a second pillar attachment assembly 130*b* coupling the second guardrail post assembly 110*b* to the second pillar 150*b*. As shown, each pillar attachment assembly 130 can comprise a pillar attachment belt 135 and one or more pillar attachment device 132 coupling the pillar attachment belt 135 to the guardrail post assembly 110.

Figure 2:
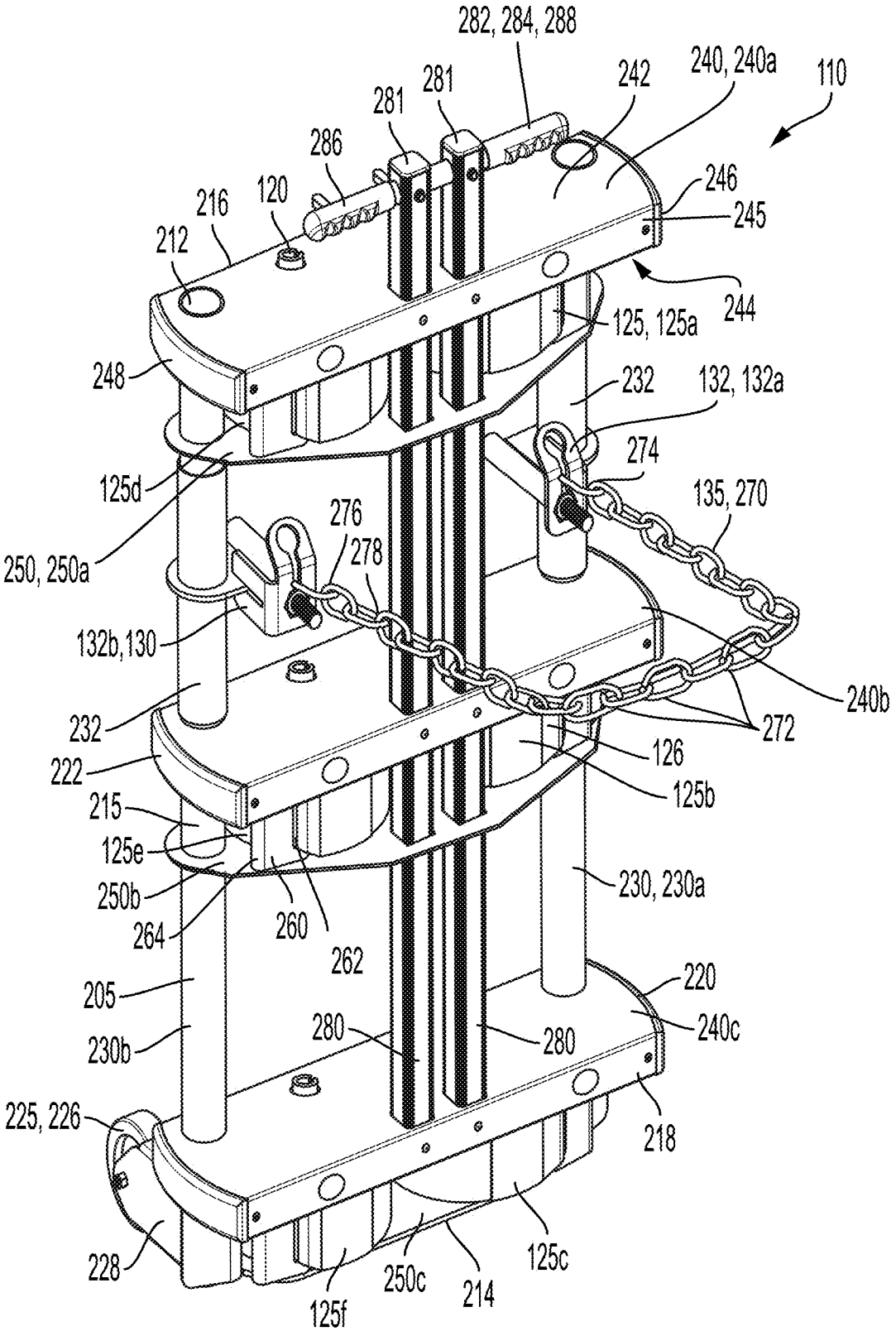
FIG. 2 is a rear perspective view of a guardrail post assembly for a fall protection system, in accordance with another aspect of the present disclosure.

Each pillar attachment device 132 can be mounted to the corresponding guardrail post assembly 110, and the corresponding pillar attachment belt 135 can extend from the pillar attachment device 132 and wrap tautly around the corresponding pillar 150. The pillar attachment belt 135 can be an attachment strap 136 (as shown in FIG. 1), an attachment chain 270 (as shown in FIG. 2), or any other suitable belting device. In the present aspect, only one of the pillar attachment assemblies 130 secures each of the first and second guardrail post assemblies 110*a,b* to the corresponding first and second pillars 150*a,b*. However, in other aspects, the fall protection system 100 can comprise additional pillar attachment assemblies 130 for securing each of the first and second guardrail post assemblies 110*a,b* to the first and second pillars 150*a,b*. According to example aspects, a length of each pillar attachment belt 135 can be sized to accommodate pillars 150 of varying thicknesses.

Figure 3:
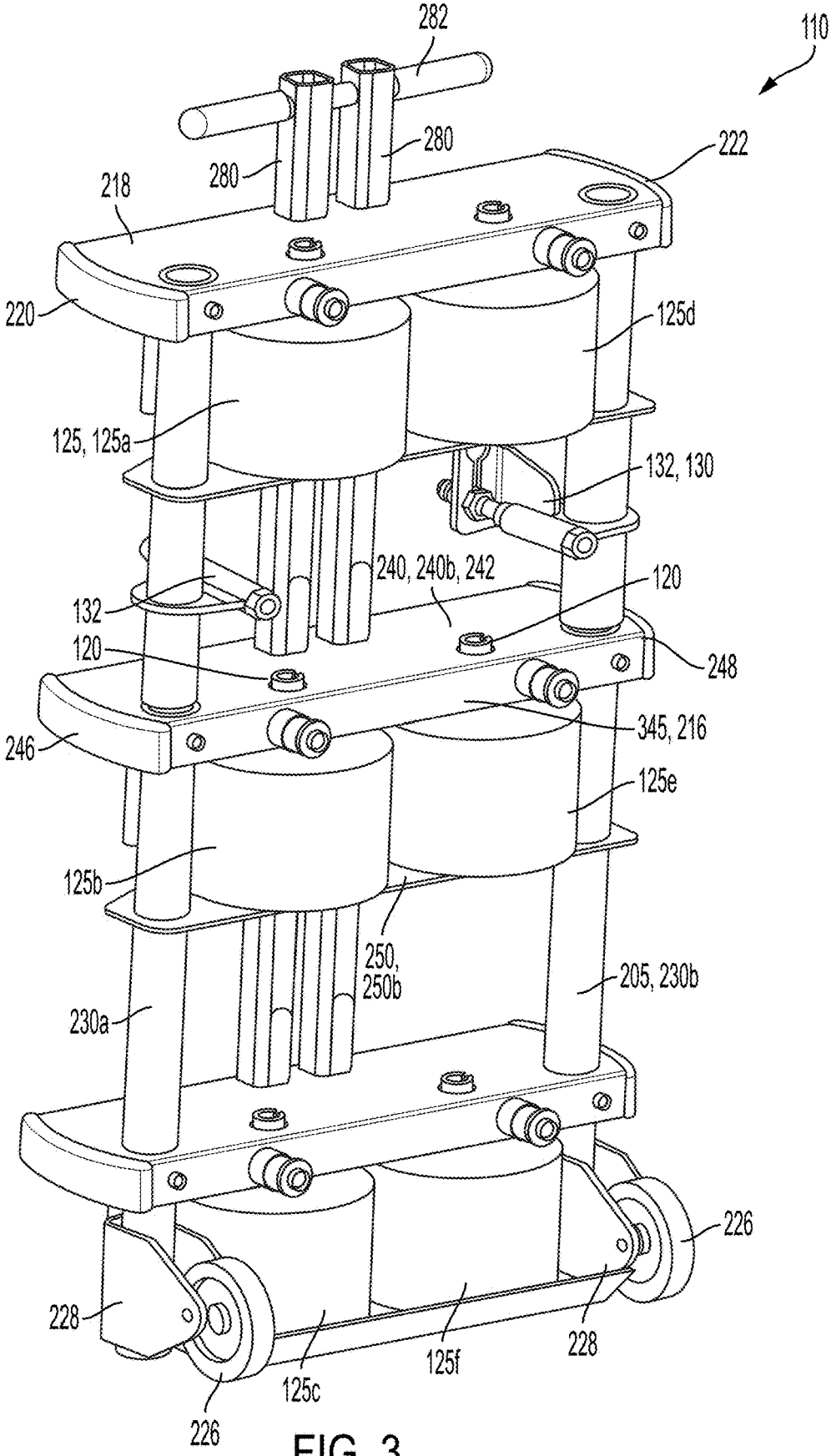
FIG. 3 is a front perspective view of the guardrail post assembly of FIG. 2.

FIGS. 2 and 3 illustrate a rear perspective view and a front perspective view, respectively, of one of the guardrail post assemblies 110, according to another example aspect of the present disclosure. In example aspects, each of the guardrail post assemblies 110 can define a front post side 216, a rear post side 218 opposite the front post side 216, a first lateral post side 220, a second lateral post side 222 opposite the first lateral post side 220, an upper post end 212, and a lower post end 214 opposite the upper post end 212. The lower post end 214 can generally confront or rest on the upper floor surface 147 (shown in FIG. 1), and the guardrail post assembly 110 can extend substantially vertically upward therefrom.

In example aspects, the guardrail post assembly 110 can comprise a movement mechanism 225 arranged at the lower post end 214 to facilitate moving the guardrail post assembly 110 across the upper floor surface 147 of the elevated floor slab 146 to a desired position adjacent to the corresponding vertical pillar 150 (each of 146, 147, and 150 shown in FIG. 1). For example, in the present aspect, the movement mechanism 225 can comprise a pair of wheels 226 that can permit the guardrail post assembly 110 to be rolled across the upper floor surface 147. In other aspects, the guardrail post assembly 110 can comprise any other suitable rolling, sliding, or gliding movement mechanism 225 to facilitate moving the guardrail post assembly 110. The wheels 226 can be arranged at the front post side 216 (as shown), with a first one of the wheels 226 positioned proximate to the first lateral post side 220 and a second one of the wheels 226 positioned proximate to the second lateral post side 222. In other aspects, the pair of wheels 226 can be positioned in any other suitable arrangement.

Example aspects of the guardrail post assembly 110 can comprise a post frame 205. The post frame 205 can comprise one or more substantially vertical mounting posts 230. In the present aspect, the guardrail post assembly 110 can comprise a substantially vertical first mounting post 230*a* proximate to the first lateral post side 220 and a substantially vertical second mounting post 230*b* parallel to the first mounting post 230*a* and proximate to the second lateral post side 222. Each of the mounting posts 230 can extend substantially from the lower post end 214 to the upper post end 212. Each of the wheels 226 can be mounted to a corresponding one of the first and second mounting posts 230*a,b* by a wheel bracket 228. In example aspects, each of the mounting posts 230 can be substantially tubular and can define a substantially circular cross-sectional shape. In other aspects, the mounting posts 230 can define any other suitable cross-sectional shape. Example aspects of the mounting posts 230 can comprise a metal material, such as steel. In some aspects, the mounting posts 230 can be formed as extruded steel posts. In other aspects, the mounting posts 230 can comprise any other suitable material known in the art, including but not limited to other metals, and/or can be manufactured using any other desired method. In other aspects, the mounting posts 230 can comprise a non-metal material.

In some aspects, the guardrail post assembly 110 can comprise an outer sleeve 232 mounted to each of the mounting posts 230, with the corresponding mounting post 230 extending therethrough. The outer sleeves 232 can be substantially cylindrical, as shown. The guardrail post assembly 110 can further comprise one or more of the guardrail straps 125, each of which can be mounted to the guardrail post assembly 110 by the corresponding guardrail attachment assembly 120. In the present aspect, the guardrail straps 125 can comprise the first upper guardrail strap 125*a*, the first middle guardrail strap 125*b*, and the first lower guardrail strap 125*c*. The first upper, middle, and lower guardrail straps 125*a,b,c* can be mounted to guardrail post assembly 110 proximate to the first mounting post 230*a* and the first lateral post side 220. Additionally, in the present aspect, the guardrail straps 125 can further comprise a second upper guardrail strap 125*d*, a second middle guardrail strap 125*e*, and a second lower guardrail strap 125*f*. The second upper, middle, and lower guardrail straps 125*d,e,f* can be mounted to the guardrail post assembly 110 proximate to the second mounting post 230*b* and the second lateral post side 222. In some aspects, as shown, the first lower guardrail strap 125*c* and the second lower guardrail strap 125*f* can be mounted on the guardrail post assembly 110 at equal heights, the first middle guardrail strap 125*b* and the second middle guardrail strap 125*e* can be mounted on the guardrail post assembly 110 at equal heights, and the first upper guardrail strap 125*a* and the second upper guardrail strap 125*d* can be mounted on the guardrail post assembly 110 at equal heights.

Example aspects of the post frame 205 can further comprise one or more attachment housings 240 mounted to and extending laterally between the first and second mounting posts 230*a,b*. In the present aspect, the one or more attachment housings 240 can comprise an upper attachment housing 240*a* proximate to the upper post end 212, a lower attachment housing 240*c* proximate to the lower post end 214, and a middle attachment housing 240*b* therebetween. In some aspects, each of the attachment housings 240 can comprise an upper housing plate 242, a lower housing plate 244 opposite the upper housing plate 242, a front housing wall 345 (shown in FIG. 3), a rear housing wall 245 opposite the front housing wall 345, a first housing sidewall 246, and a second housing sidewall 248 opposite the first housing sidewall 246.

The post frame 205 can further comprise one or more mounting plates 250 mounted to and extending laterally between the first and second mounting posts 230*a,b*. In the present aspect, the one or more mounting plates 250 can comprise an upper mounting plate 250*a* proximate to the upper post end 212, a lower mounting plate 250*c* proximate to the lower post end 214, and a middle mounting plate 250*b* therebetween. According to example aspects, each of the upper, middle, and lower attachment housings 240*a,b,c* can be arranged vertically above the corresponding upper, middle, and lower mounting plates 250*a,b,c*, respectively.

The first upper guardrail strap 125*a* and the second upper guardrail strap 125*d* can be mounted to the guardrail post assembly 110 by the corresponding guardrail attachment assembly 120 between the upper attachment housing 240*a* and the upper mounting plate 250*a*. The first middle guardrail strap 125*b* and the second middle guardrail strap 125*e* can be mounted to the guardrail post assembly 110 by the corresponding guardrail attachment assembly 120 between the middle attachment housing 240*b* and the middle mounting plate 250*b*. As shown, the first middle guardrail strap 125*b* and the second middle guardrail strap 125*e* can be arranged at a middle post region 215 of the guardrail post assembly 110 between the upper post end 212 and the lower post end 214. The first lower guardrail strap 125*c* and the second lower guardrail strap 125*f* can be mounted to the guardrail post assembly 110 by the corresponding guardrail attachment assembly 120 between the lower attachment housing 240*c* and the lower mounting plate 250*c*.

Each of the guardrail straps 125 can be rolled up around the corresponding guardrail attachment assembly 120, prior to extending the guardrail straps 125 to form the upright boundary 105 (shown in FIG. 1). Each of the guardrail straps 125 can define the corresponding free end 126, which can be pulled laterally outward away from the guardrail post assembly 110 to unravel and extend the guardrail strap 125. In example aspects, the free end 126 of each guardrail strap 125 can be coupled to a strap connector 260, as shown. The strap connector 260 can define a connector slot 262 through which the free end 126 of the guardrail strap 125 can pass and an attachment hook 264 for coupling the strap connector 260 of the extended guardrail strap 125 to another one of the guardrail post assemblies 110, a reinforcement post assembly, or other suitable post assembly.

The guardrail post assembly 110 can further comprise the pillar attachment assembly 130 for coupling the guardrail post assembly 110 to the vertical pillar 150 (shown in FIG. 1). As shown, the pillar attachment assembly 130 can comprise a pillar attachment belt 135 and a pair of pillar attachment devices 132 coupling the pillar attachment belt 135 to the guardrail post assembly 110. In the present aspect, the pillar attachment belt 135 can be the attachment chain 270 comprising a plurality of chain links 272. A first chain end 274 of the attachment chain 270 can be coupled to a first pillar attachment device 132*a* of the pair of pillar attachment devices 132, and a second chain end 276 of the attachment chain 270 opposite the first chain end 274 can be coupled to a second pillar attachment device 132*b* of the pair of pillar attachment devices 132.

The first pillar attachment device 132*a* can be coupled to the first mounting post 230*a* of the guardrail post assembly 110, and the second pillar attachment device 132*b* can be coupled to the second mounting post 230*b*. In example aspects, the first pillar attachment device 132*a* can be coupled to the first mounting post 230*a* between the upper mounting plate 250*a* and the middle attachment housing 240*b*. Similarly, the second pillar attachment device 132*b* can be coupled to the second mounting post 230*b* between the upper mounting plate 250*a* and the middle attachment housing 240*b*. In other aspects, the first and second pillar attachment devices 132*a,b* can be mounted at any other suitable location on the guardrail post assembly 110. An intermediate chain portion 278 between the first chain end 274 and the second chain end 276 can extend rearwardly from the guardrail post assembly 110 and can be wrapped around the corresponding vertical pillar 150. In example aspects, the attachment chain 270 can be selectively tightened, as described in further detail below, to tautly hug the pillar 150. According to example aspects, the attachment chain 270 can be flexible to allow the attachment chain 270 to conform to pillars 150 of any cross-sectional shape, including, for example and without limitation, circular, triangular, rectangular, and the like.

Example aspects of the guardrail post assembly 110 can further comprise one or more substantially vertical spine posts 280 for reinforcing the guardrail post assembly 110. For example, the guardrail post assembly 110 can comprise a laterally adjacent pair of the spine posts 280 arranged proximate to the rear post side 218 thereof. The laterally adjacent pair of the spine posts 280 can be positioned about centrally between the first lateral post side 220 and the second lateral post side 222 as shown. In the present aspect, each of the spine posts 280 can extend upward from the lower attachment housing 240*c*, through the middle mounting plate 250*b*, the middle attachment housing 240*b*, the upper mounting plate 250*a*, and the upper attachment housing 240*a*, and upward beyond the upper attachment housing 240*a*. Example aspects of the spine posts 280 can be substantially hollow, and in the present aspect, can define a substantially square or rectangular cross-sectional shape. In other aspects, the spine posts 280 can define any other suitable shape. In some aspects, the spine posts 280 can be formed as extruded steel posts. In other aspects, the spine posts 280 can comprise any other suitable material known in the art, including but not limited to other metals, and/or can be manufactured using any other desired method. In other aspects, the spine posts 280 can comprise a non-metal material.

In some example aspects, as shown, the guardrail post assembly 110 can comprise a handle bar 282 mounted to and extending through each of the spine posts 280 at an upper spine end 281 thereof. The handle bar 282 can define a first handle portion 284 extending laterally outward from the pair of spine posts 280 towards the first lateral post side 220 and a second handle portion 286 extending laterally outward from the pair of spine posts 280 towards the second lateral post side 222. In some aspects, each of the first handle portion 284 and the second handle portion 286 can comprise a rubber grip 288. The first and second handle portions 284,286 of the handle bar 282 can be gripped by an operator to facilitate guiding the movement of the guardrail post assembly 110 as the guardrail post assembly 110 is rolled across the upper floor surface 147 on the wheels 226.

Figure 4:
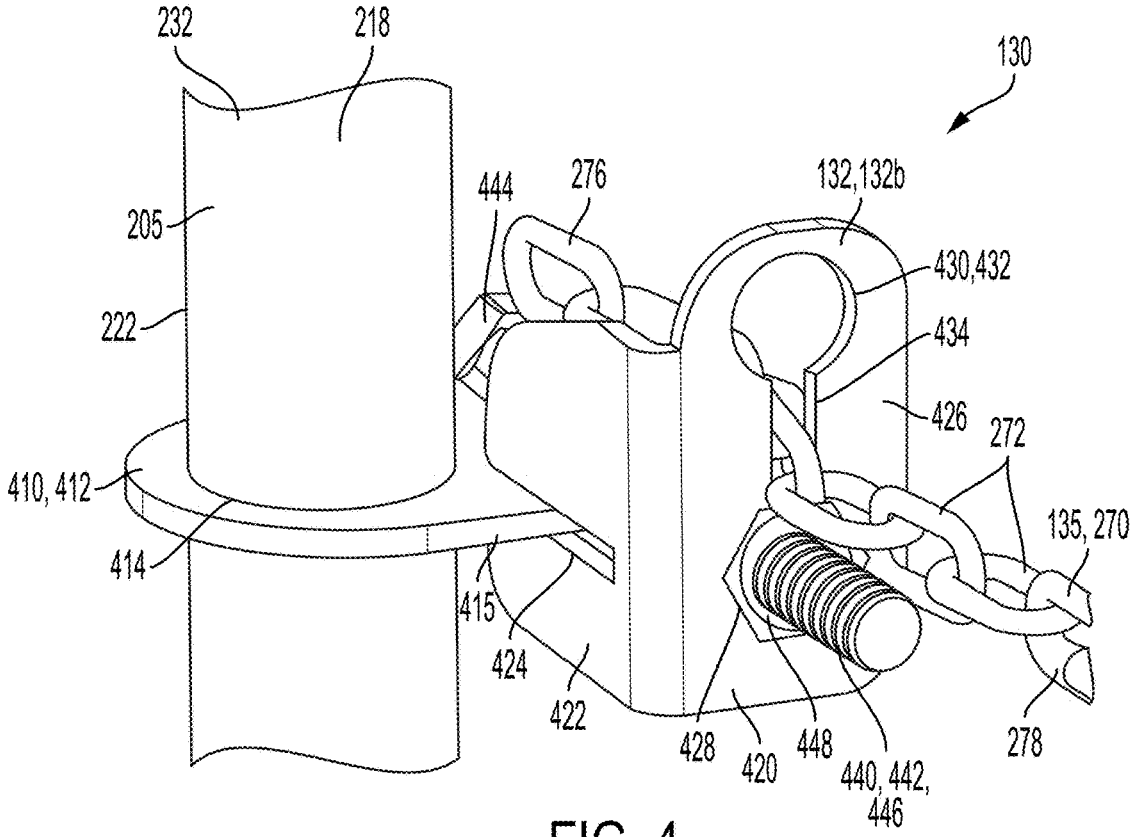
FIG. 4 is a detail rear perspective view of a pillar attachment assembly of the guardrail post assembly of FIG. 2.
Figure 5:
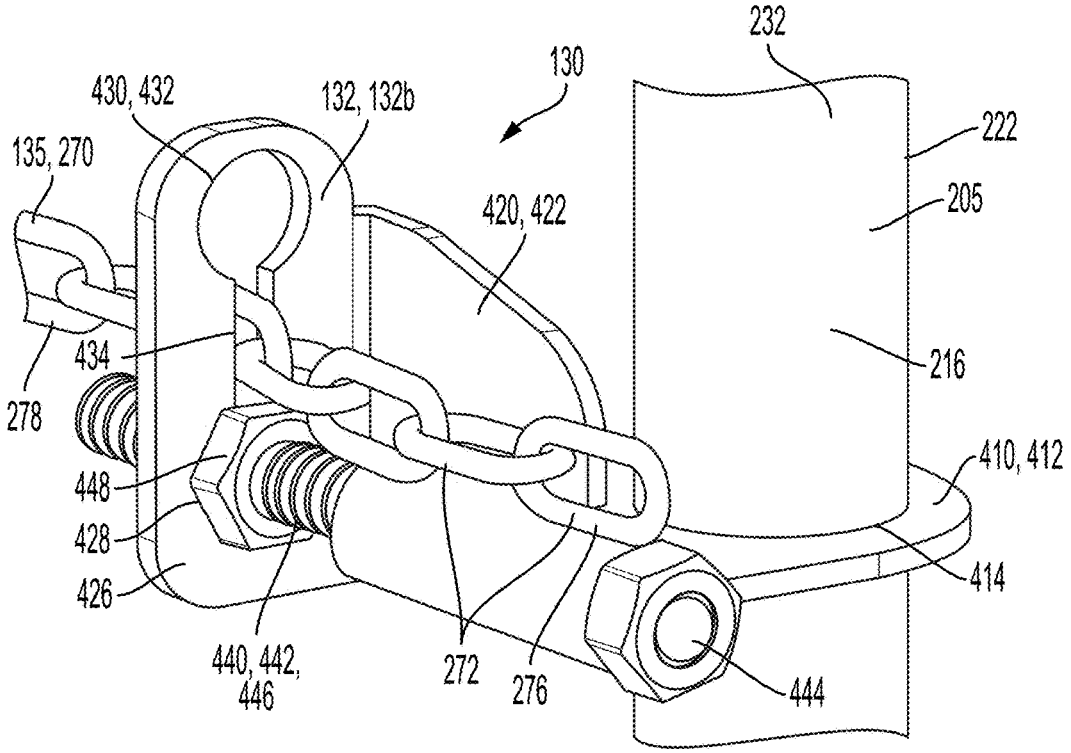
FIG. 5 is a detail front perspective view of the pillar attachment assembly of FIG. 4.

FIGS. 4 and 5 illustrate detail rear and front perspective views, respectively, the pillar attachment assembly 130 of the guardrail post assembly 110. The pillar attachment assembly 130 can comprise the pillar attachment belt 135 (e.g., the attachment chain 270) and the pair of pillar attachment devices 132. The first pillar attachment device 132*a* (shown in FIG. 2) can be coupled to the first mounting post 230*a* (shown in FIG. 2), and the second pillar attachment device 132*b* can be coupled to the second mounting post 230*b* (shown in FIG. 2). The first chain end 274 (shown in FIG. 2) of the attachment chain 270 can be coupled to the first pillar attachment device 132*a*, and the second chain end 276 of the attachment chain 270 can be coupled to the second pillar attachment device 132*b*. The intermediate chain portion 278 between the first chain end 274 and the second chain end 276 can extend rearwardly from the guardrail post assembly 110. The intermediate chain portion 278 can be selectively tightened around the corresponding vertical pillar 150 (shown in FIG. 1) to securely attach the guardrail post assembly 110 thereto.

According to example aspects, each of the pillar attachment devices 132 can comprise a post mounting bracket 410 and a chain attachment bracket 420. The chain attachment bracket 420 can be secured to the post mounting bracket 410 by a bracket fastener 440, and the attachment chain 270 can be coupled to the chain attachment bracket 420. The post mounting bracket 410 can be secured to the corresponding mounting post 230 (shown in FIG. 2) to attach the pillar attachment device 132 to the guardrail post assembly. More specifically, in some aspects, the post mounting bracket 410 can be attached to the outer sleeve 232 mounted on the mounting post 230. In other aspects, the post mounting bracket 410 may not be attached to the outer sleeve 232 and can be attached directly to the mounting post 230.

In some example aspects, either or both of the post mounting bracket 410 and the chain attachment bracket 420 can comprise a metal material, such as steel for example and without limitation. More specifically, in some aspects, either or both of the post mounting bracket 410 and the chain attachment bracket 420 can be formed by laser-cutting and bending monolithic steel plates. However, in other aspects, the post mounting bracket 410 and/or the chain attachment bracket 420 may not be monolithically formed (i.e., formed a singular component that constitutes a single material without joints or seams) and/or may be manufactured using other desired methods, such as stamping, casting, or machining. In other aspects, the post mounting bracket 410 and/or the chain attachment bracket 420 can comprise any other suitable material or combination of materials having suitable durability, such as, for example, other metals, plastics, composites, and the like.

The post mounting bracket 410 can comprise a mounting portion 412 defining a bracket opening 414 through which the outer sleeve 232 (and the mounting post 230 therein) can extend. The mounting portion 412 can be arranged substantially horizontally, relative to the orientation shown. According to example aspects, the post mounting bracket 410 can further comprise a fastener sleeve 516 (shown in FIG. 5) coupled to the mounting portion 412. The fastener sleeve 516 can be substantially tubular and can be configured to receive a portion of the bracket fastener 440 therethrough. In example aspects, the post mounting bracket 410, including the mounting portion 412 and the fastener sleeve 516, can be monolithically formed. For example, in the present aspect, the post mounting bracket 410 can be bent relative to the mounting portion 412 into a tubular shape at an inner bracket end 518 (shown in FIG. 5) of the post mounting bracket 410 to define the fastener sleeve 516. The bracket fastener 440 can be a threaded bolt 442 in the present aspect; however, in other aspects, the bracket fastener 440 can be any other suitable fastener known in the art. The threaded bolt 442 can comprise a bolt head 444 and a threaded shaft 446. The threaded shaft 446 can extend from the bolt head 444 through the fastener sleeve 516, towards the chain attachment bracket 420. The bolt head 444 can be sized to prevent the bolt head 444 from passing through the fastener sleeve 516.

The chain attachment bracket 420 can be substantially L-shaped in the present aspect, and can be arranged substantially vertically, relative to the orientation shown. The L-shaped chain attachment bracket 420 can define an adjustment portion 422 and an attachment portion 426 oriented substantially perpendicular to the adjustment portion 422. In example aspects, the chain attachment bracket 420, including the adjustment portion 422 and the attachment portion 426, can be monolithically formed. For example, in the present aspect, the adjustment portion 422 can be bent relative to the attachment portion 426 to define the L-shape of the chain attachment bracket 420.

The adjustment portion 422 can be configured to slidably engage the mounting portion 412 of the post mounting bracket 410. For example, as shown, the adjustment portion 422 can define an adjustment slot 424 configured to slidably receive a rearward edge 415 of the mounting portion 412. The attachment portion 426 can define a fastener opening 428 for receiving the bracket fastener 440 to couple the chain attachment bracket 420 to the post mounting bracket 410. The attachment portion 426 can further define a chain slot 430 for receiving the attachment chain 270 to couple the attachment chain 270 to the chain attachment bracket 420. In example aspects, the chain slot 430 can be a key-hole chain slot 430. The key-hole chain slot 430 can define a wide portion 432 and a narrow portion 434 in communication with the wide portion 432. In some aspects, the fastener opening 428 can be arranged opposite the wide portion 432 and can also be in communication with the narrow portion 434.

To couple the attachment chain 270 to the pillar attachment device 132, the corresponding first chain end 274 or second chain end 276 can be fed through the wide portion 432 of the key-hole chain slot 430 of the chain attachment bracket 420. One of the chain links 272 can then be dropped down from the wide portion 432 into the narrow portion 434 of the key-hole chain slot 430. As with any standard-type chain, the chain links 272 of the attachment chain 270 can be connected together such that the chain links 272 alternate orientations (e.g., one chain link 272 in a substantially vertical orientation, the next in a substantially horizontal orientation, the next in the substantially vertical orientation, and so on). As shown, the chain link 272 received in the narrow portion 434 can be oriented in the substantially vertical orientation, and the narrow portion 434 can be sized to prevent the adjacent chain links 272 in the substantially horizontal orientation from passing therethrough.

The attachment chain 270 can be wrapped tautly around the corresponding vertical pillar 150 and then be secured to each of the pillar attachment devices 132 as described. The attachment chain 270 can then further be tightened around the vertical pillar 150 by sliding each of the chain attachment brackets 420 of each pillar attachment device 132 towards the corresponding post mounting bracket 410. According to example aspects, a threaded nut 448 can be attached to the chain attachment bracket 420. The threaded nut 448 can be mounted within the fastener opening 428 of the attachment portion 426 in the present aspect. In example aspects, each of the threaded nut 448 and the fastener opening 428 can be substantially hexagonal in shape, which can prohibit the threaded nut 448 from rotating relative to the attachment portion 426. The threaded shaft 446 of the bracket fastener 440 can extend through the fastener sleeve 516 of the post mounting bracket 410 and can threadedly engage the threaded nut 448 of the chain attachment bracket 420. The bracket fastener 440 can be rotated to advance the threaded shaft 446 of the threaded bolt 442 through the threaded nut 448, drawing the threaded nut 448 and the chain attachment bracket 420 towards the post mounting bracket 410. As chain attachment bracket 420 is drawn towards the post mounting bracket 410, the mounting portion 412 of the post mounting bracket 410 can slide further into the adjustment slot 424 of the chain attachment bracket 420. The bracket fastener 440 can be tightened until the attachment chain 270 is suitably taut around the vertical pillar 150.

Figure 6:
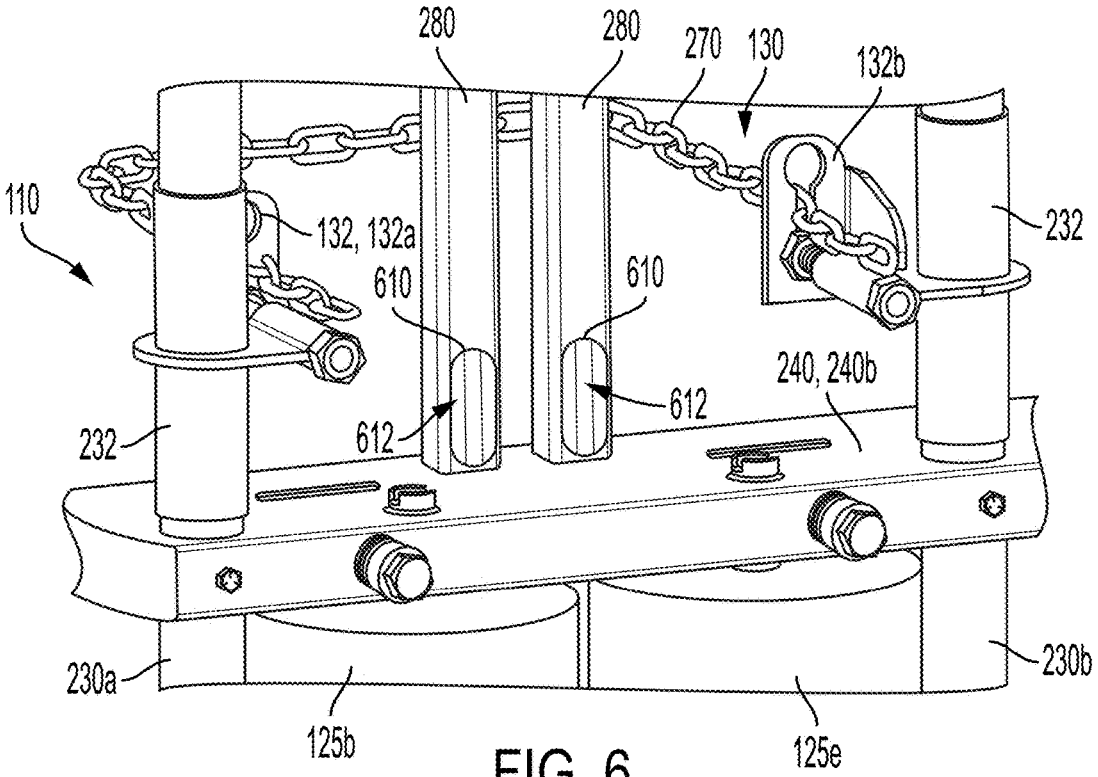
FIG. 6 is a front perspective view of the pillar attachment assembly of FIG. 4.

FIG. 6 illustrates a front perspective view of the pillar attachment assembly 130 of the guardrail post assembly 110. According to example aspects, one or both of the spine posts 280 can define a storage opening 610. In the present aspect, each of the spine posts 280 can define one of the storage openings 610 at a location between the upper mounting plate 250*a* (shown in FIG. 1) and the middle attachment housing 240*b*, proximate to the pillar attachment assembly 130. The storage openings 610 can allow access to a hollow interior 612 of the corresponding spine post 280. In example aspects, any excess length of the attachment chain 270 can be fed into the hollow interior 612 of either of the spine posts 280, through the corresponding storage opening 610, for storage of the attachment chain 270 when the guardrail post assembly 110 is not in use.

Figure 7:
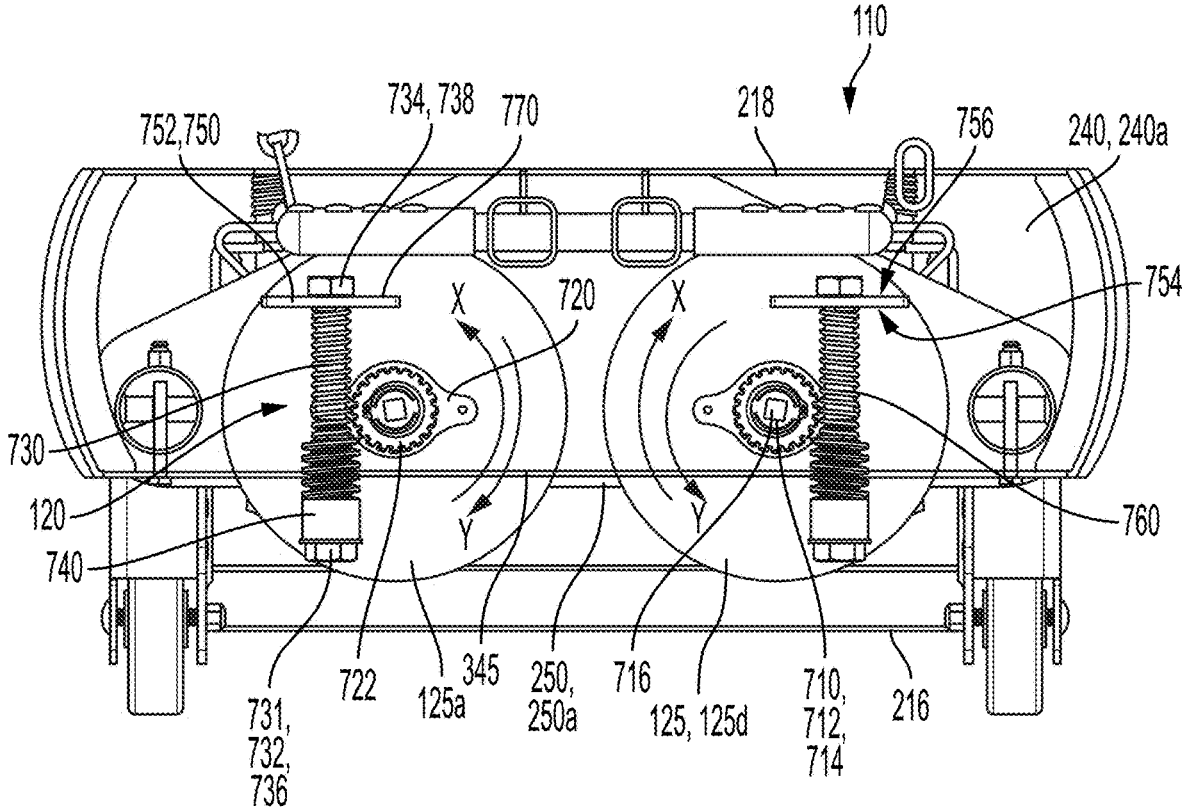
FIG. 7 is a top view of the guardrail post assembly of FIG. 2 with an upper attachment housing of the guardrail post assembly illustrated as transparent.
Figure 8:
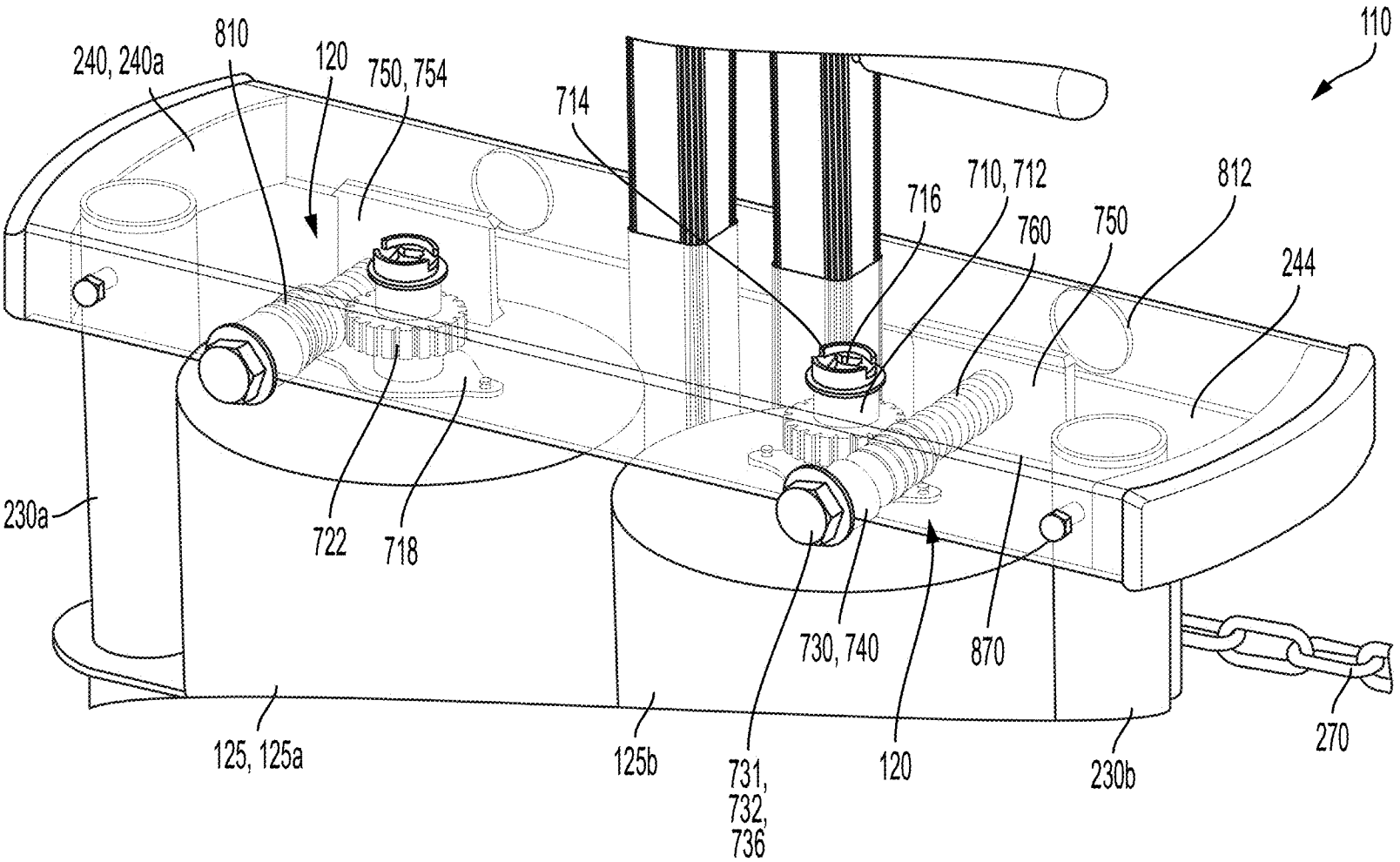
FIG. 8 is detail front perspective view of the guardrail post assembly of FIG. 2 with the upper attachment housing of FIG. 7 illustrated as transparent.

FIGS. 7 and 8 illustrate top and front perspective views, respectively, of the guardrail post assembly 110, wherein the upper attachment housing 240*a* is illustrated as transparent for visibility of the components housed therein. Various components of the guardrail attachment assemblies 120 can be housed within the corresponding attachment housing 240. The pair of guardrail attachment assemblies 120 for attaching the first upper guardrail strap 125*a* and the second upper guardrail strap 125*d* are shown in FIGS. 7 and 8. According to example aspects, each of the guardrail attachment assemblies 120 can comprise a strap mounting portion 710 and a locking portion 730. The strap mounting portion 710 can comprise a substantially vertical mounting tube 712, relative to the orientation shown, that can extend between and can be rotatably coupled to each of the corresponding attachment housing 240 and mounting plate 250, and the corresponding guardrail strap 125 can be mounted to the mounting tube 712.

The strap mounting portion 710 can comprise a housing mounting bracket 718 coupled to the mounting tube 712 and configured to couple the strap mounting portion 710 to the lower housing plate 244 (shown in FIG. 8) of the attachment housing 240. The strap mounting portion 710 can further comprise a plate mounting bracket 915 (shown in FIG. 9) coupled to the mounting tube 712 and configured to couple the strap mounting portion 710 to the mounting plate 250. In example aspects, the housing mounting bracket 718 can be mounted externally to the attachment housing 240. In other aspects, the housing mounting bracket 718 may be disposed within the attachment housing 240. In example aspects, the mounting tube 712 can extend upward into the attachment housing 240 and downward into the mounting plate 250. The mounting tube 712 can define an upper tube end 714 and a lower tube end 922 (shown in FIG. 9) opposite the upper tube end 714. In example aspects, the upper tube end 714 can extend upward beyond the attachment housing 240, and the lower tube end 922 can extend downward beyond the mounting plate 250.

According to example aspects, in a disengaged configuration (shown) of the guardrail attachment assembly 120, the strap mounting portion 710 can be disengaged from the locking portion 730, and both the strap mounting portion 710 and the guardrail strap 125 can be free to rotate relative to the corresponding attachment housing 240 and mounting plate 250. The strap mounting portion 710 and the guardrail strap 125 can be rotated in a first direction (i.e., an unrolling direction), as indicated by directional arrow X, to unroll and extend the guardrail strap 125, and in an opposite second direction, as indicated by directional arrow Y (i.e., a winding direction), to roll the guardrail strap 125 back up around the mounting tube 712. The guardrail strap 125 can be manually rolled up around or unrolled from the strap mounting portion 710 by an operator, or the rotation of the mounting tube 712 and guardrail strap 125 can be driven by a tool. For example, the mounting tube 712 can define an engagement opening 716 at the upper tube end 714 that can be engaged by a ratchet or drill to drive the rotation of the strap mounting portion 710.

The locking portion 730 of the guardrail attachment assembly 120 can be mounted to and arranged at least partially within the attachment housing 240. Example aspects of the locking portion 730 can comprise a locking bolt 731. In the present aspect, the locking bolt 731 can comprise a first set screw 732 and a separate second set screw 734. Each of the first and second set screws 732,734 can be hex head set screws 732,734 in the present aspect. The first set screw 732 can define a first screw head 736 of the locking bolt 731 and the second set screw 734 can define an opposite second screw head 738 of the locking bolt 731. A worm gear 740 can be mounted to each of the first and second set screws 732,734, proximate to the first screw head 736, to couple the first set screw 732 to the second set screw 734. A bolt plate 750 can be mounted to the second set screw 734 proximate to the second screw head 738. In example aspects, the bolt plate 750 can be fixedly secured to the attachment housing 240. For example, an upper plate end 752 of the bolt plate 750 can engage an upper plate slot 770 of the upper housing plate 242 and a lower plate end 930 (shown in FIG. 9) of the bolt plate 750 can engage a lower plate slot 870 (shown in FIG. 8) of the lower housing plate 244.

A compression spring 760 can be mounted to the second set screw 734 between the worm gear 740 and a front face 754 of the bolt plate 750. As shown, in the disengaged position of the guardrail attachment assembly 120, the compression spring 760 positioned between the worm gear 740 and the fixed bolt plate 750 can bias the assembly of the first set screw 732, the second set screw 734, and the worm gear 740 towards the front post side 216 of the guardrail post assembly 110. The bolt plate 750 can remain fixed in position, and the second set screw 734 can be configured to slide within a screw opening 932 (shown in FIG. 9) of the bolt plate 750, as described in further detail below. In example aspects, the second screw head 738 of the second set screw 734 can abut a rear face 756 of the bolt plate 750, opposite the front face 754, in the disengaged configuration. Furthermore, in the disengaged configuration, the worm gear 740 and the second set screw 734 can extend through a front opening 810 (shown in FIG. 8) in the front housing wall 345 of the attachment housing 240. The worm gear 740 can be arranged at least partially external to the attachment housing 240, and the first screw head 736 of the first set screw 732 can be arranged external to the attachment housing 240, as shown. Each of the second set screw 734, the compression spring 760, and the bolt plate 750 can be disposed within the attachment housing 240 in the disengaged configuration.

According to example aspects, the strap mounting portion 710 of the guardrail attachment assembly 120 can comprise a worm wheel 722 disposed within the attachment housing 240. In the disengaged configuration, the worm wheel 722 can be disengaged from the worm gear 740 of the locking portion 730 to allow the mounting tube 712 to rotate freely, as described above. In an engaged configuration of the guardrail attachment assembly 120, the worm gear 740 can engage the worm wheel 722 to prohibit the guardrail strap 125 from being further unrolled in the first direction X, as described in further detail below.

Figure 9:
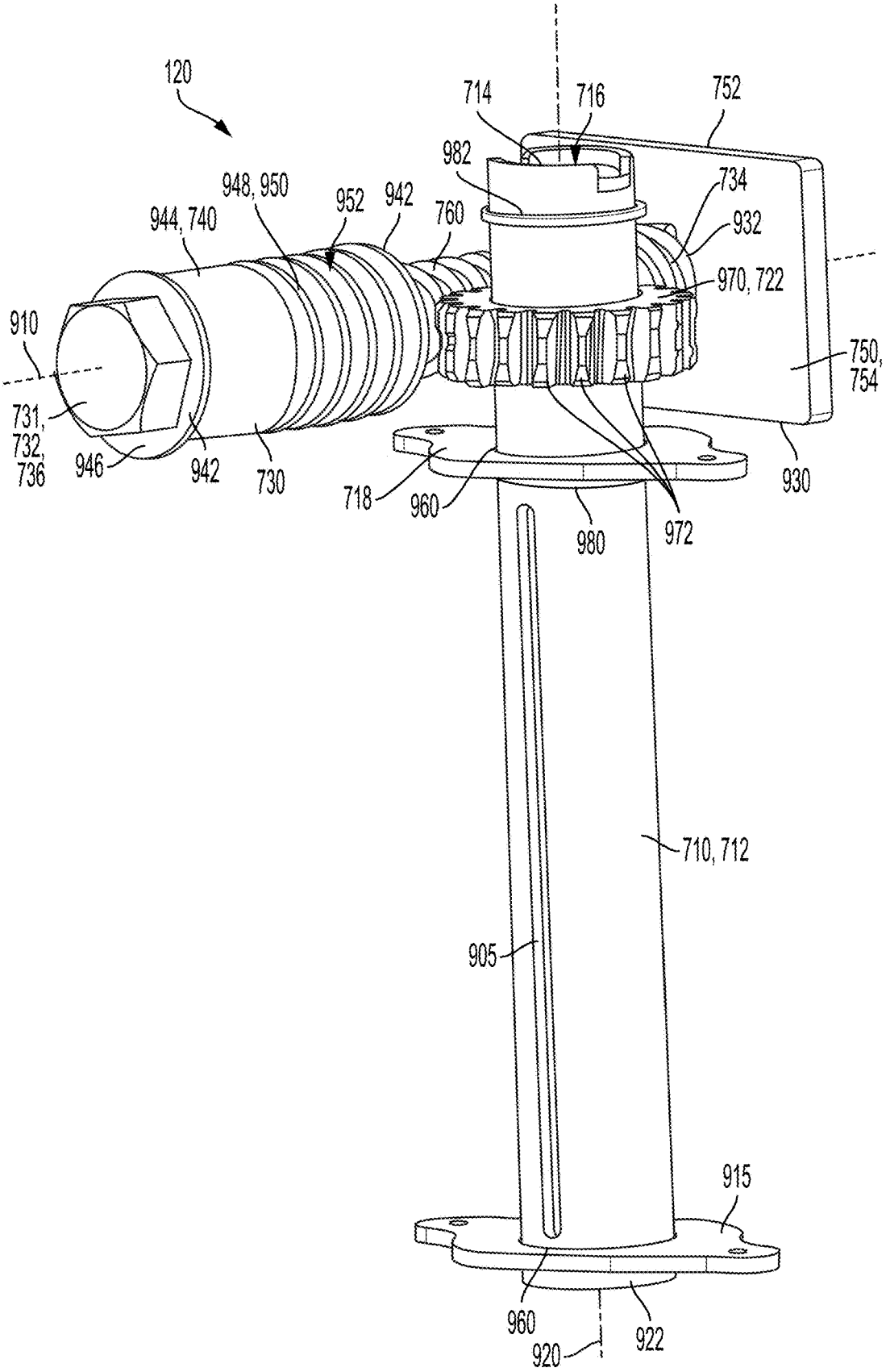
FIG. 9 is a front perspective view of a guardrail attachment assembly of the guardrail post assembly of FIG. 2.
Figure 10:
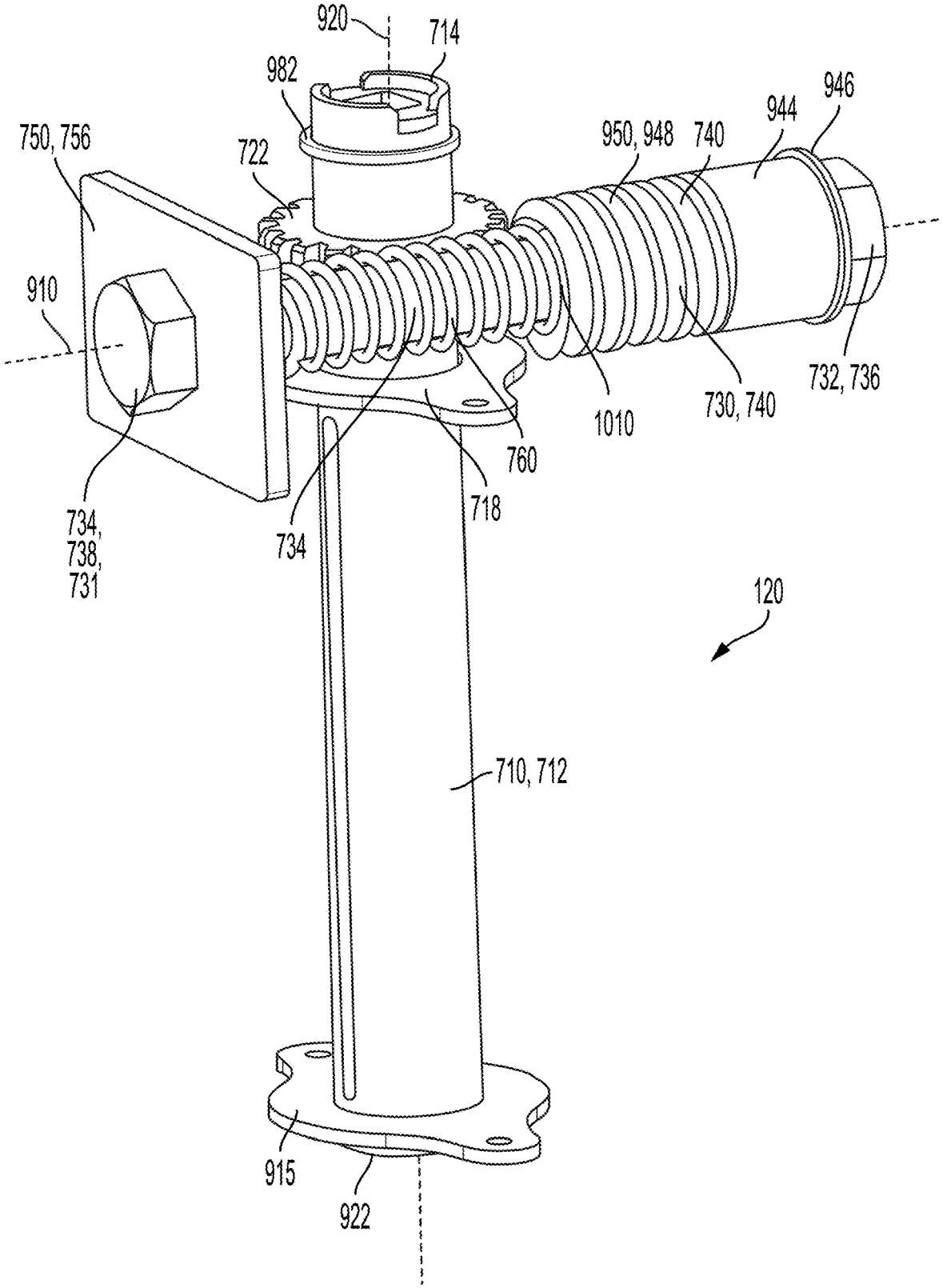
FIG. 10 is a rear perspective view of the guardrail attachment assembly of FIG. 9.
Figure 11:
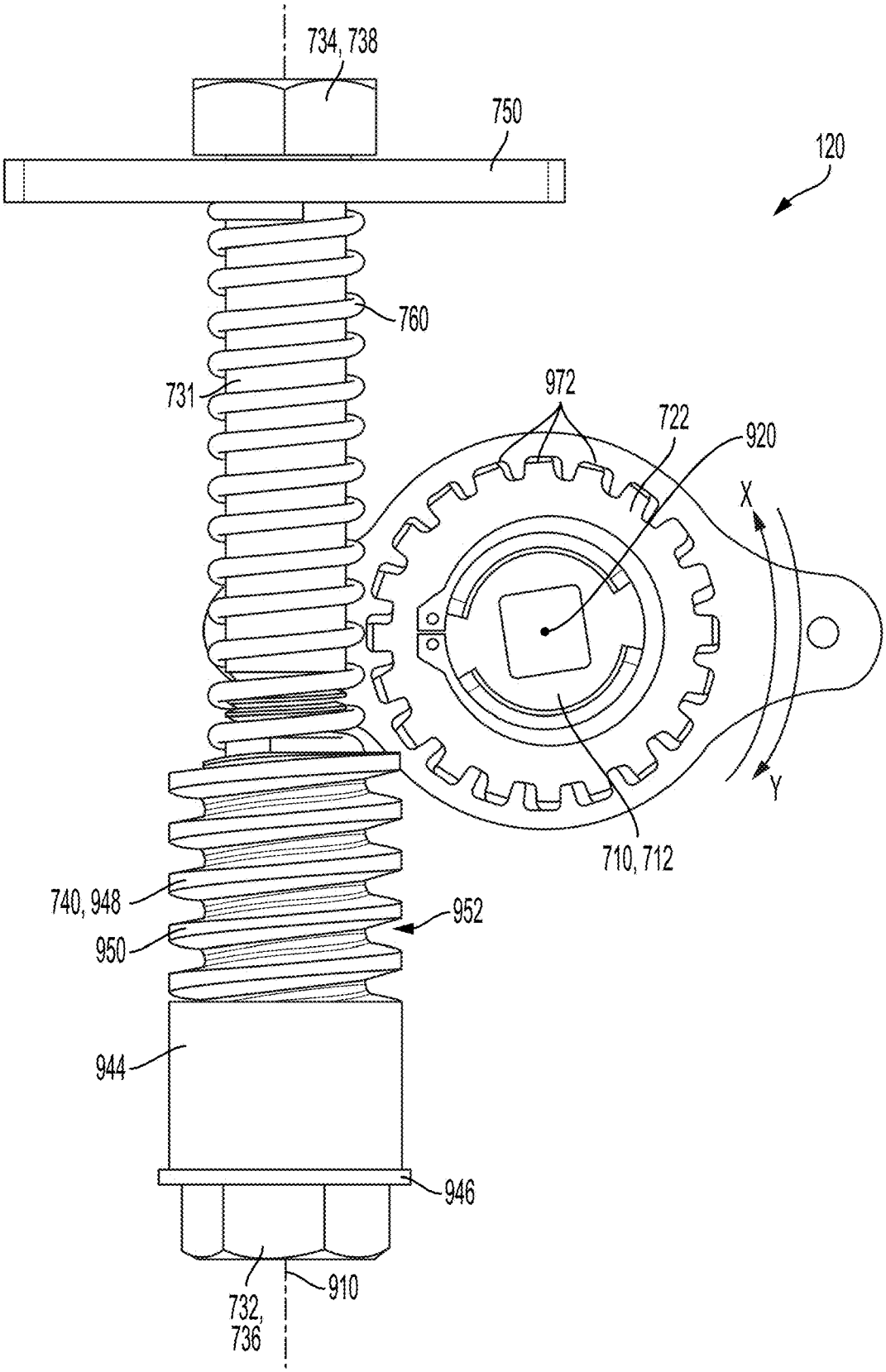
FIG. 11 is a top view of the guardrail attachment assembly of FIG. 9.

FIGS. 9, 10, and 11 illustrate front perspective, rear perspective, and top views of the guardrail attachment assembly 120. The guardrail attachment assembly 120 can comprise the strap mounting portion 710 and the locking portion 730. According to example aspects, the strap mounting portion 710 can comprise the substantially vertical mounting tube 712 to which the guardrail strap 125 (shown in FIG. 1) can be mounted. The mounting tube 712 can define a substantially vertical strap engagement slot 905, as shown. A connected end of the guardrail strap 125, opposite the free end 126 (shown in FIG. 1), can be threaded into the strap engagement slot 905, and then the guardrail strap 125 can be rolled up around the mounting tube 712. The engagement opening 716 of the guardrail attachment assembly 120 can be formed in the mounting tube 712 at the upper tube end 714. Each of the housing mounting bracket 718 and the plate mounting bracket 915 can define a tube opening 960 through which the mounting tube 712 can extend. The mounting tube 712 can be configured to rotate relative to each of the housing mounting bracket 718 and the plate mounting bracket 915. The plate mounting bracket 915 can be arranged proximate to the lower tube end 922, and the housing mounting bracket 718 can be arranged between the lower tube end 922 and the upper tube end 714. The guardrail strap 125 can be mounted to the mounting tube 712 between the housing mounting bracket 718 and the plate mounting bracket 915. The worm wheel 722 can be mounted to the mounting tube 712 between the housing mounting bracket 718 and the upper tube end 714. The worm wheel 722 can be configured to rotate along with the mounting tube 712 as the guardrail strap 125 is extended and withdrawn in the disengaged configuration. Example aspects of the worm wheel 722 can define a wheel hub 970 coupled to the mounting tube 712 and a plurality of wheel spokes 972 extending radially outward from the wheel hub 970, relative to a substantially vertical tube axis 920 of the mounting tube 712.

In some aspects, a first retaining ring 980 can be mounted to the mounting tube 712 between the guardrail strap 125 and the housing mounting bracket 718, and a second retaining ring 982 can be mounted to the mounting tube 712 proximate to the upper tube end 714. The first retaining ring 980 can prohibit the mounting tube 712 from sliding vertically upward through upper and lower housing openings 1310,1312 (shown in FIG. 13) of the attachment housing 240 (shown in FIG. 2). The second retaining ring 982 can be arranged external to the attachment housing 240 and can be configured to support the strap mounting portion 710 on the upper housing plate 242 of the attachment housing 240 and to prohibit the mounting tube 712 from sliding vertically downward through a plate opening 1320 (shown in FIG. 13) of the mounting plate 250 (shown in FIG. 2). Thus, the attachment housing 240 can be held between the first and second retaining rings 980,982.

Referring now to the locking portion 730, the locking portion 730 can be arranged about perpendicular to the substantially vertical mounting tube 712. The locking portion 730 can comprise the locking bolt 731, which in the present aspect can comprise both the first set screw 732 and the second set screw 734. In other aspects, the locking bolt 731 can comprise a single, elongated bolt or screw. Each of the first set screw 732 and the second set screw 734 can be screwed into a threaded bore 1010 (shown in FIG. 10) of the worm gear 740 at opposing gear ends 942 thereof to couple the first and second set screws 732,734 together and to mount the worm gear 740 to the locking bolt 731. In example aspects, the worm gear 740 can define an unthreaded, substantially cylindrical shaft portion 944 positioned proximate the first screw head 736 of the first set screw 732. A stop flange 946 having an increased diameter compared to a diameter of the shaft portion 944 can extend from the shaft portion 944 adjacent to the first screw head 736. In some aspects, the first screw head 736 can abut the stop flange 946, as shown. The worm gear 740 can further define a threaded gear portion 948 extending from the shaft portion 944 towards the compression spring 760 and defining a spiral threading 950.

The bolt plate 750 can be mounted to the second set screw 734 proximate to the second screw head 738 (shown in FIG. 10). The bolt plate 750 can define the screw opening 932 and the second set screw 734 can extend therethrough. The compression spring 760 can be mounted to the second set screw 734 between the worm gear 740 and the front face 754 of the bolt plate 750. As previously described, in the disengaged position of the guardrail attachment assembly 120, the compression spring 760 can bias worm gear 740 away from the fixed bolt plate 750. The second set screw 734 can slide within the screw opening 932 of the bolt plate 750 to allow the worm gear 740 to be biased forward towards the front post side 216 (shown in FIG. 2). In example aspects, the second screw head 738 of the second set screw 734 can abut the rear face 756 of the bolt plate 750 in the disengaged configuration, as shown in FIG. 10.

As best seen in FIG. 11, in the disengaged configuration, the compression spring 760 can bias the threaded gear portion 948 of the worm gear 740 forward past the worm wheel 722 of the strap mounting portion 710 to prevent the worm wheel 722 from engaging the worm gear 740. Moreover, in the disengaged configuration, at least a portion of the worm gear 740, such as the shaft portion 944, can extend through the front housing wall 345 (shown in FIG. 3) of the attachment housing 240 (shown in FIG. 2). In example aspects, both the shaft portion 944 of the worm gear 740 and the first screw head 736 of the first set screw 732 can extend forward beyond the front housing wall 345 to jut outwards from the attachment housing 240. In some aspects, part of the threaded gear portion 948 can also extend forward beyond the front housing wall 345 in the disengaged configuration.

To configure the guardrail attachment assembly 120 in the engaged configuration, the worm gear 740 can be pushed rearward through the front opening 810 (shown in FIG. 8) of the front housing wall 345 and into the attachment housing 240. For example, the operator can manually press against the first screw head 736 of the first set screw 732 to overcome the spring force of the compression spring 760 and push the worm gear 740 towards the bolt plate 750. One or more of the wheel spokes 972 of the worm wheel 722 can engage a helical recess 952 defined by the spiral threading 950 of the threaded gear portion 948. Once the worm wheel 722 has engaged the worm gear 740, the spiral shape of the spiral threading 950 can prohibit the worm gear 740 from being biased forward by the compression spring 760, thereby retaining the worm gear 740 in engagement with the worm wheel 722. Thus, the guardrail strap 125 (shown in FIG. 1) can be prevented from being further unrolled in the first direction X.

The guardrail strap 125 can then be tightened (e.g., rolled back up around the mounting tube 712) to a desired tension. To tension the guardrail strap 125, the assembly of the locking bolt 731 and the worm gear 740 can be driven rearwardly to further compress the compression spring 760 between the worm gear 740 and the bolt plate 750. For example, a tool, such as a ratchet, drill or any other suitable tool, can engage and rotate the first screw head 736 of the first set screw 732 in a tightening direction about a substantially horizontal bolt axis 910 of the locking bolt 731. Rotating the first set screw 732 can simultaneously rotate the worm gear 740 and the second set screw 734. As the worm gear 740 is rotated, the engagement of the gear portion 948 of the worm gear 740 with the worm wheel 722 can drive the worm gear 740 rearward towards the bolt plate 750, compressing the compression spring 760 therebetween. In example aspects, the stop flange 946 of the worm gear 740 can engage the front housing wall 345 (shown in FIG. 3) to prohibit the stop flange 946 and the first screw head 736 from passing through the front opening 810 (shown in FIG. 8). The second set screw 734 can slide through the screw opening 932 (shown in FIG. 9) in the bolt plate 750 as the compression spring 760 is compressed. In some aspects, a rear opening 812 (shown in FIG. 8) can be formed in the rear housing wall 245 (shown in FIG. 2) of the attachment housing 240, and the second screw head 738 of the second set screw 734 may pass through the rear opening 812 as the compression spring 760 is compressed.

As described, the wheel spokes 972 of the worm wheel 722 can be engaged with the helical recess 952 of the worm gear 740. The rotational and rearward motion of the worm gear 740 can rotate the worm wheel 722 about the tube axis 920 (going into the page in FIG. 11) in the second direction Y, i.e., the winding direction. The worm wheel 722 can be mounted to the mounting tube 712, and the guardrail strap 125 can be mounted to the mounting tube 712. As the worm wheel 722 is rotated in the second direction Y, the guardrail strap 125 can be wound up around the mounting tube 712, thereby tensioning the extended portion of the guardrail strap 125 and creating the taut upright boundary 105 (shown in FIG. 1) for preventing accidental falls from the elevated slab 145 (shown in FIG. 1).

Figure 12:
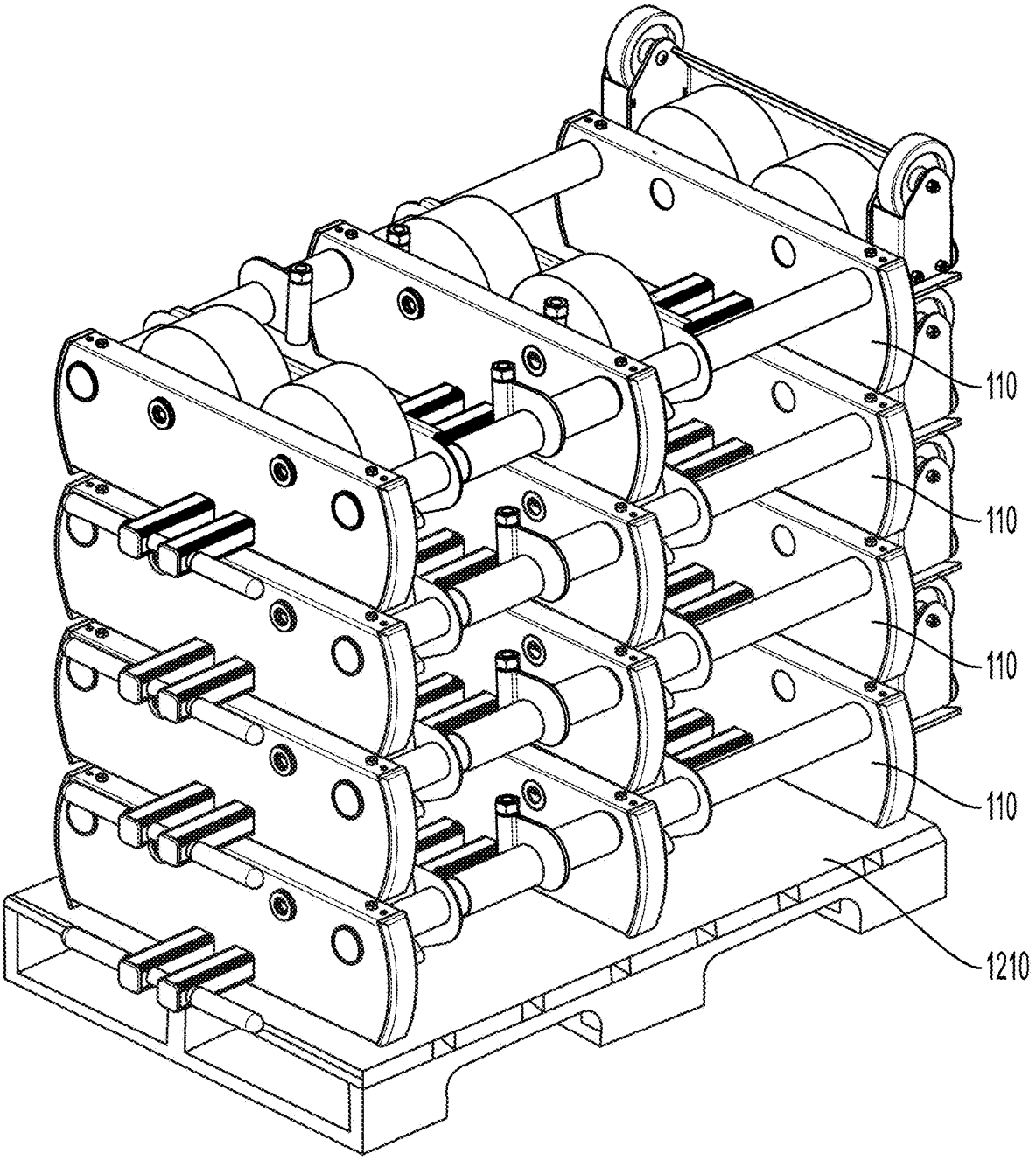
FIG. 12 is a perspective view of a plurality of the guardrail post assemblies of FIG. 2 stacked on a pallet.

FIG. 12 illustrates a plurality of the guardrail post assemblies 110 stacked on a pallet 1210. The guardrail post assemblies 110 can be stacked as shown for easy transportation and/or storage. In example aspects, each of the guardrail post assemblies 110 can be lain in a substantially horizontal orientation and stacked vertically on top of one another for transportation and/or storage.

Figure 13:
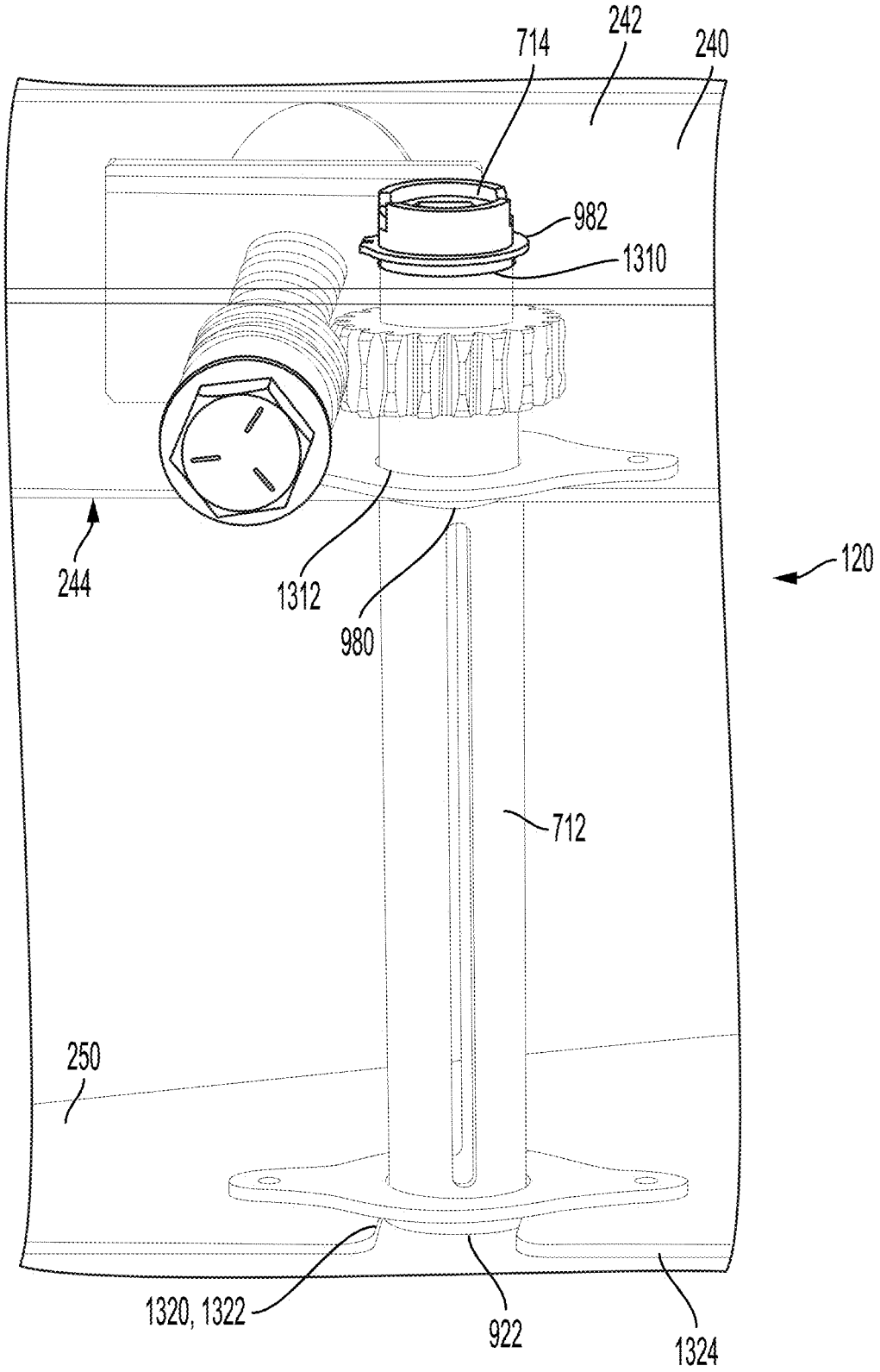
FIG. 13 is a perspective view of the guardrail attachment assembly of FIG. 9.

FIG. 13 illustrates the mounting tube 712 of the guardrail attachment assembly 120 engaging each of the attachment housing 240 (illustrated as transparent) and the mounting plate 250. The attachment housing 240 can define the lower housing opening 1312 formed through the lower housing plate 244 and the upper housing opening 1310 formed through the upper housing plate 242. As shown, the mounting tube 712 can extend through each of the lower housing opening 1312 and the upper housing opening 1310, and the upper tube end 714 of the mounting tube 712 can extend upward beyond the upper housing plate 242. The first retaining ring 980 mounted to the mounting tube 712 can prohibit the mounting tube 712 from sliding vertically upward through the lower housing opening 1312, and the second retaining ring 982 mounted to the mounting tube 712 can prohibit the mounting tube 712 from sliding vertically downward through the upper housing opening 1310, thereby securing the mounting tube 712 to the attachment housing 240. Additionally, the mounting plate 250 can define the plate opening 1320 formed therethrough. The mounting tube 712 can extend into the plate opening 1320, and in some aspects, the lower tube end 922 can extend downward beyond the mounting plate 250. In the present aspect, the plate opening 1320 can be formed as forward plate slot 1322 extending into a forward plate edge 1324 of the mounting plate 250. In other aspects, however, the forward plate slot 1322 can extend into the mounting plate 250 at any other suitable location, or the plate opening 1320 may not be formed as a slot at all.

Figure 14:
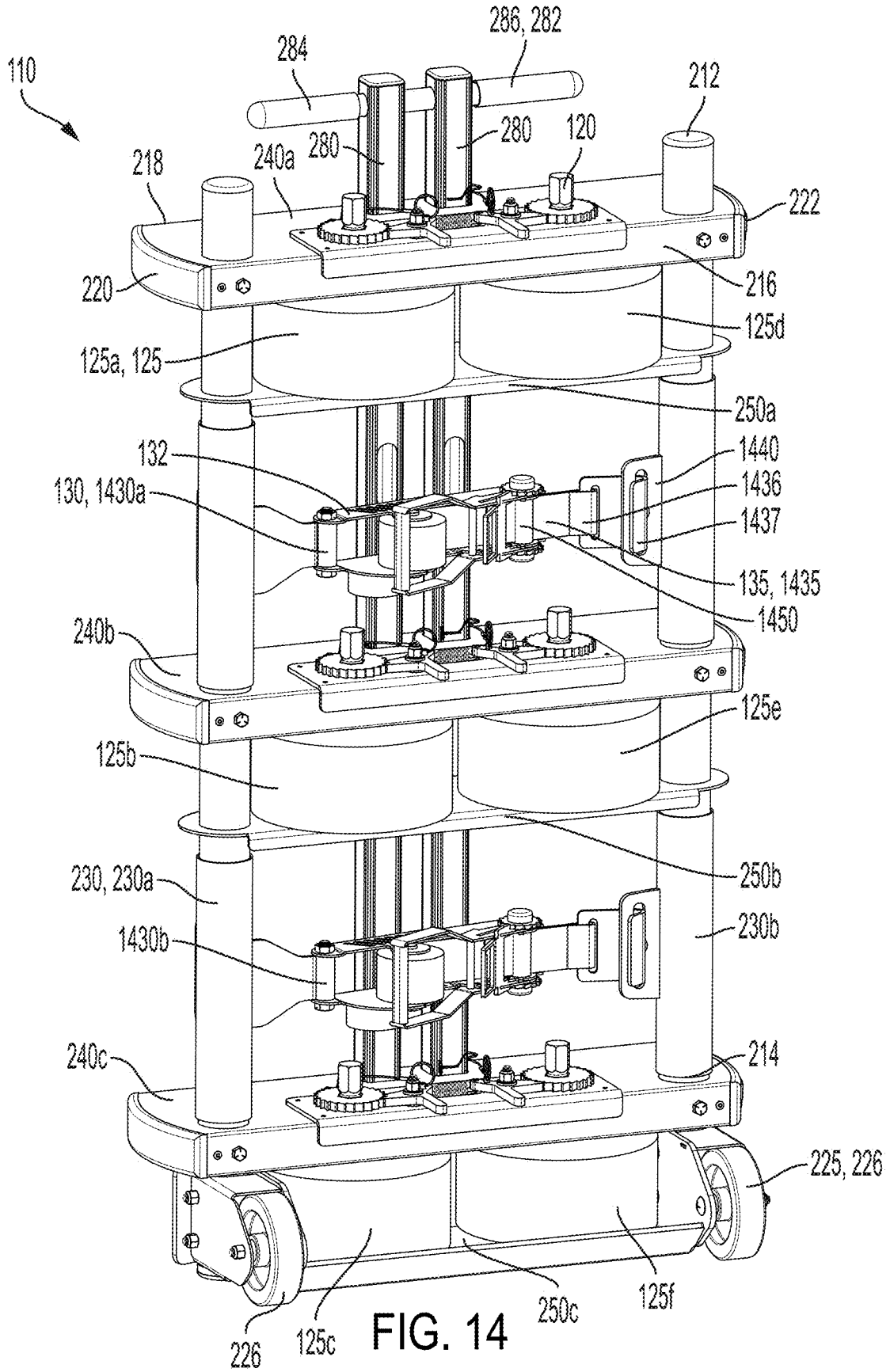
FIG. 14 is a front perspective view of the guardrail post assembly, in accordance with another aspect of the present disclosure.

FIGS. 14-17 illustrate the guardrail post assembly 110 according to another example aspect of the present disclosure. Referring to FIG. 14, the guardrail post assembly 110 can define the front post side 216, the rear post side 218 opposite the front post side 216, the first lateral post side 220, the second lateral post side 222 opposite the first lateral post side 220, the upper post end 212, and the lower post end 214 opposite the upper post end 212. The movement mechanism 225 can be arranged at the lower post end 214 to facilitate moving the guardrail post assembly 110 across the elevated floor slab 146 (shown in FIG. 1). The movement mechanism 225 can comprise the pair of wheels 226, for example and without limitation.

The guardrail post assembly 110 can comprise the post frame 205. The post frame 205 can comprise the substantially vertical first mounting post 230*a* proximate to the first lateral post side 220 and the substantially vertical second mounting post 230*b* parallel to the first mounting post 230*a* and proximate to the second lateral post side 222. Each of the mounting posts 230 can extend substantially from the lower post end 214 to the upper post end 212 and can be substantially tubular in the present aspect. As previously described, example aspects of the mounting posts 230 can be formed as extruded steel posts, for example and without limitation. Other aspects of the mounting posts 230 can comprise any other suitable material known in the art and/or can be manufactured using any other desired method.

The guardrail post assembly 110 can further comprise one or more of the guardrail straps 125, each mounted to the guardrail post assembly 110 by the corresponding guardrail attachment assembly 120. For example, the guardrail straps 125 can comprise the first upper, first middle, and first lower guardrail straps 125*a,b,c* and the second upper, second middle, and second lower guardrail straps 125*d,e,f*. The post frame 205 can comprise the upper, middle, and lower attachment housings 240*a,b,c* mounted to and extending laterally between the first and second mounting posts 230*a, b*. The post frame 205 can further comprise the upper, middle, and lower mounting plates 250*a,b,c* mounted to and extending laterally between the first and second mounting posts 230*a,b*.

The first upper guardrail strap 125*a* and the second upper guardrail strap 125*d* can be mounted to the guardrail post assembly 110 by the corresponding guardrail attachment assembly 120 between the upper attachment housing 240*a* and the upper mounting plate 250*a*. Similarly, the first middle guardrail strap 125*b* and the second middle guardrail strap 125*e* can be mounted between the middle attachment housing 240*b* and the middle mounting plate 250*b*, and the first lower guardrail strap 125*c* and the second lower guardrail strap 125*f* can be mounted between the lower attachment housing 240*c* and the lower mounting plate 250*c*. Each of the guardrail straps 125 can be rolled up around the corresponding guardrail attachment assembly 120 prior to extending the guardrail straps 125 to form the upright boundary 105 (shown in FIG. 1). In the present aspect, each of the guardrail attachment assemblies 120 can comprise a guardrail ratchet and pawl system 1410, as described in further detail below with respect to FIG. 15.

The guardrail post assembly 110 can further comprise one or more of the pillar attachment assemblies 130 for coupling the guardrail post assembly 110 to the vertical pillar 150 (shown in FIG. 1). In the present aspect, the guardrail post assembly 110 can comprise an upper pillar attachment assembly 1430*a* and a lower pillar attachment assembly 1430*b*. The upper pillar attachment assembly 1430*a* can be arranged vertically between the upper mounting plate 250*a* and the middle attachment housing 240*b*, and the lower pillar attachment assembly 1430*b* can be arranged vertically between the middle mounting plate 250*b* and the lower attachment housing 240*c*.

Each pillar attachment assembly 130 can comprise the pillar attachment belt 135 and one of the pillar attachment devices 132 coupling the pillar attachment belt 135 to the guardrail post assembly 110. The pillar attachment belts 135 can be wrapped around the pillar 150 to secure the guardrail post assembly 110 thereto. In the present aspect, each of the pillar attachment belts 135 can be a pillar attachment strap 1435. Example aspects of the pillar attachment strap 1435 can comprise a plastic material, such as, for example, nylon webbing. In other aspects, the pillar attachment strap 1435 can comprise any other suitable material known in the art. In some aspects, the pillar attachment strap 1435 can be inelastic or semi-inelastic, while in other aspects, the pillar attachment strap 1435 can be elastic. The pillar attachment strap 1435 can be flexible to allow the pillar attachment strap 1435 to conform to pillars 150 of any cross-sectional shape.

Each of the pillar attachment straps 1435 can be rolled up around the corresponding pillar attachment device 132 prior to extending the pillar attachment strap 1435 around the substantially vertical pillar 150. A free strap end 1436 of the pillar attachment strap 1435 can be connected to a pillar attachment hook 1437. Prior to wrapping the pillar attachment strap 1435 around the pillar 150, the pillar attachment hook 1437 can removably engage a retaining bracket 1440 mounted to the post frame 205. In the present aspect, the retaining bracket 1440 can be mounted to the second mounting post 230*b*. In the present aspect, each of the pillar attachment assemblies 130 can comprise a pillar ratchet and pawl system 1450, as described in further detail below with respect to FIGS. 16 and 17.

Example aspects of the guardrail post assembly 110 can further comprise the one or more substantially vertical spine posts 280 for reinforcing the guardrail post assembly 110, as previously described. Some example aspects of the guardrail post assembly 110 can further comprise the handle bar 282. The handle bar 282 can define the first handle portion 284 extending laterally outward from the pair of spine posts 280 towards the first lateral post side 220 and the second handle portion 286 extending laterally outward from the pair of spine posts 280 towards the second lateral post side 222. The first and second handle portions 284,286 can be gripped by an operator to facilitate guiding the movement of the guardrail post assembly 110 across the elevated floor slab 146 on the wheels 226.

Figure 15:
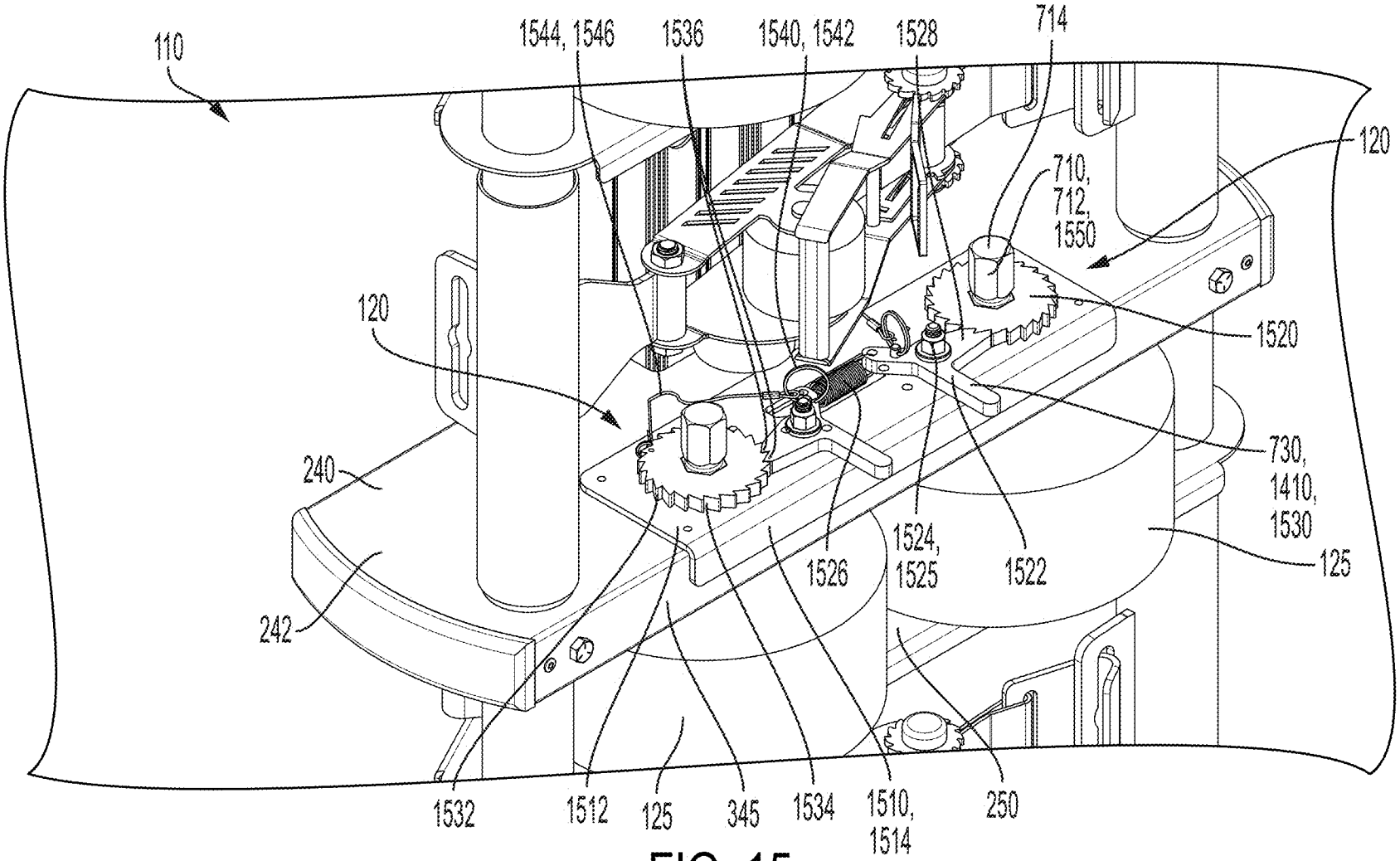
FIG. 15 is a detail front perspective view of the guardrail attachment assembly of the guardrail post assembly of FIG. 14.

FIG. 15 is a detail view of a pair of the guardrail attachment assemblies 120. In some aspects, each of the guardrail attachment assemblies 120 can be substantially the same. The guardrail attachment assembly 120 can comprise the strap mounting portion 710 and the locking portion 730. The strap mounting portion 710 can comprise the substantially vertical mounting tube 712 extending between and rotatably coupled to each of the corresponding attachment housing 240 and mounting plate 250. The corresponding guardrail strap 125 can be rolled up around the mounting tube 712, as previously described. The strap mounting portion 710 can be operably connected to the locking portion 730 of the guardrail attachment assembly 120, which in the present aspect, can comprise the guardrail ratchet and pawl system 1410.

According to example aspects, the mounting tube 712 can extend through the corresponding attachment housing 240 and the upper tube end 714 can extend upward past the upper housing plate 242 of the attachment housing 240. The guardrail ratchet and pawl system 1410 can be connected to the mounting tube 712 proximate to the upper tube end 714. In some aspects, a reinforcement plate 1510 can be mounted atop the upper housing plate 242 of the attachment housing 240, and the guardrail ratchet and pawl system 1410 can be mounted over the reinforcement plate 1510, as shown. In some aspects, the reinforcement plate 1510 can be substantially L-shaped and can define a substantially planar mounting section 1512 confronting the upper housing plate 242 and a substantially planar side section 1514 extending from the mounting section 1512 along the front housing wall 345 of the attachment housing 240.

The guardrail ratchet and pawl system 1410 can comprise a ratchet 1520 and a pawl 1522. The pawl 1522 can be pivotably mounted to the mounting section 1512 of the reinforcement plate 1510. For example, the pawl 1522 can be pivotably mounted to the mounting section 1512 by a pawl fastener 1524. The pawl fastener 1524 can be a nut and bolt assembly 1525, as shown, or any other suitable fastener known in the art. The ratchet 1520 can be fixedly mounted to the mounting tube 712 proximate to the upper tube end 714 thereof. As previously described, the mounting tube 712 can be configured to rotate relative to the attachment housing 240 to allow the corresponding guardrail strap 125 to be wound up on and unwound from the mounting tube 712.

The pawl 1522 can be biased to an engaged position, wherein the pawl 1522 can engage the ratchet 1520 to prohibit the ratchet 1520 from rotating, and thereby prohibit the guardrail strap 125 from being wound/unwound. For example, the pawl 1522 can be biased into engagement with the ratchet 1520 by a pawl spring 1526 or other resilient device. In the present aspect, a single pawl spring 1526 can service adjacent ones of the guardrail attachment assemblies 120. Example aspects the pawl 1522 can define an engagement portion 1528 and a lever portion 1530. The ratchet 1520 can define a plurality of ratchet teeth 1532 spaced circumferentially about the ratchet 1520. A ratchet recess 1534 can be defined between each adjacent pair of the ratchet teeth 1532. In the engaged position, the engagement portion 1528 of the pawl 1522 can engage one or more of the ratchet recesses 1534 of the ratchet 1520, prohibiting rotation of the mounting tube 712. In the present aspect, the engagement portion 1528 of the pawl 1522 can comprise a pair of pawl teeth 1536 configured to engage an adjacent pair of the ratchet recesses 1534 in the engaged position.

In some aspects, the pawl 1522 can be selectively secured in the engaged position by a locking element 1540. In the present aspect, the locking element 1540 can be a locking pin 1542. The locking pin 1542 can engage each of the pawl 1522 and the reinforcement plate 1510 to secure the pawl 1522 in the engaged position. The locking pin 1542 can also engage the attachment housing 240 in some aspects. To allow the pawl 1522 to be disengaged from the ratchet 1520, the locking pin 1542 can be selectively withdrawn from the locking pin 1542. In some aspects, the locking pin 1542 can further be affixed to the guardrail post assembly 110 by a pin retainer 1544, such as a pin cable 1546 for example and without limitation, to prevent accidental loss of the locking pin 1542.

The ratchet teeth 1532 can be canted to allow the ratchet 1520 to easily rotate in a first direction (e.g., in a winding direction, wherein the guardrail strap 125 can be increasingly rolled up around the mounting tube 712), but prohibiting rotation of the ratchet 1520 in the opposite direction (e.g., in an unwinding direction, wherein the guardrail strap 125 can be unwound from the mounting tube 712). For example, the rotation of the ratchet 1520 in the winding direction (such as for tensioning the guardrail strap 125 after it has been extended and connected to an adjacent guardrail post assembly 110) can be driven by a tool, such as a manual or electric ratchet wrench or drill, or any other suitable tool. In the present aspect, the mounting tube 712 can define an upper tube end portion 1550 defining a hexagonal cross-sectional shape at the upper tube end 714 thereof. The hexagonal upper tube end portion 1550 of the mounting tube 712 can be engaged and driven in the winding direction by an electric ratchet wrench, an impact driver or cordless drill with a socket attachment, or other suitable tool. As the ratchet 1520 is driven in the winding direction, the engagement portion 1528 of the pawl 1522 can slide along the canted ratchet teeth 1532 and drop into the ratchet recesses 1534.

To reconfigure the pawl 1522 in a disengaged position to allow the ratchet 1520 to rotate in the unwinding direction for extension of the guardrail strap 125, the locking pin 1542 can be removed, and a force can be applied to the lever portion 1530 of the pawl 1522 to overcome the spring force of the pawl spring 1526 and push the pawl 1522 out of engagement with the corresponding ratchet recess 1534. The force can be a manually applied force, for example and without limitation. When the pawl 1522 disengages the ratchet recess 1534, the mounting tube 712 can be permitted to rotate freely in the unwinding direction and the guardrail strap 125 can be unrolled therefrom. The guardrail strap 125 can be unrolled, for example, by applying a pulling force to the free end 126 of the guardrail strap 125. In other aspects, the guardrail strap 125 can be unrolled by driving the ratchet 1520 in the unwinding direction with a tool, as previously described, such as with an electric ratchet wrench or an impact driver or cordless drill with a socket attachment, for example and without limitation. When the force is removed from the lever portion 1530, the pawl spring 1526 can bias the pawl 1522 back into engagement with the ratchet 1520, thereby prohibiting further extension of the guardrail strap 125.

Figure 16:
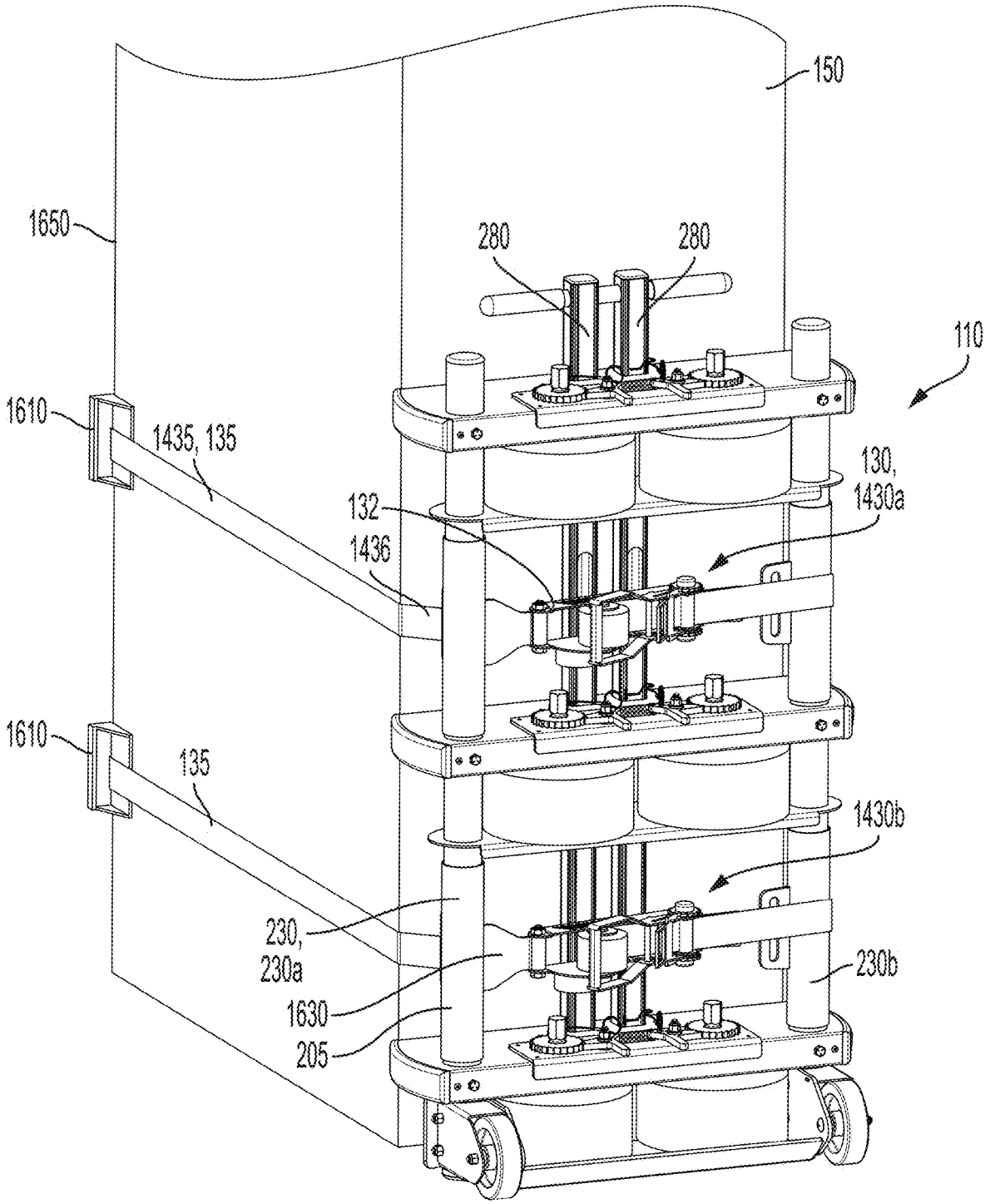
FIG. 16 is a front perspective view of the guardrail post assembly of FIG. 14 secured to a pillar.

FIG. 16 illustrates the guardrail post assembly 110 secured to the substantially vertical pillar 150. The substantially vertical pillar 150 can define a substantially rectangular cross-sectional shape in the present aspect. In other aspects, the pillar 150 can define any other suitable shape. The guardrail post assembly 110 can comprise the upper pillar attachment assembly 1430*a* and the lower pillar attachment assembly 1430*b*. Each of the pillar attachment assemblies 130 can be mounted to the post frame 205. In the present aspect, each of the pillar attachment assemblies 130 can be mounted to the first mounting post 230*a* by a frame mounting bracket 1630. In other aspects, the pillar attachment assemblies 130 can also or alternatively be mounted to the second mounting post 230*b*, one or more of the substantially vertical spine posts 280, and/or any other suitable portion of the guardrail post assembly 110.

Each pillar attachment assembly 130 can comprise the pillar attachment belt 135 and one of the pillar attachment devices 132 coupling the pillar attachment belt 135 to the guardrail post assembly 110. The pillar attachment device 132 of each pillar attachment assembly 130 can be cantilevered from the first mounting post 230*a* by the frame mounting bracket 1630. The pillar attachment belts 135 can be wrapped around the vertical pillar 150 to secure the guardrail post assembly 110 thereto. In the present aspect, each of the pillar attachment belts 135 can be one of the pillar attachment straps 1435, as previously described. The pillar attachment strap 1435 can be rolled up around the corresponding pillar attachment device 132 in an un-extended configuration (shown in FIGS. 14 and 15), and can be at least partially unrolled from the pillar attachment device 132 to wrap around the pillar 150 in an extended configuration (shown in FIGS. 16 and 17). In some aspects, each of the pillar attachment assemblies 130 can comprise one or more edge guides 1610 each mounting to a corresponding pillar edge 1650 of the pillar 150 and configured to guide and position the pillar attachment strap 1435 around the pillar 150

Figure 17:
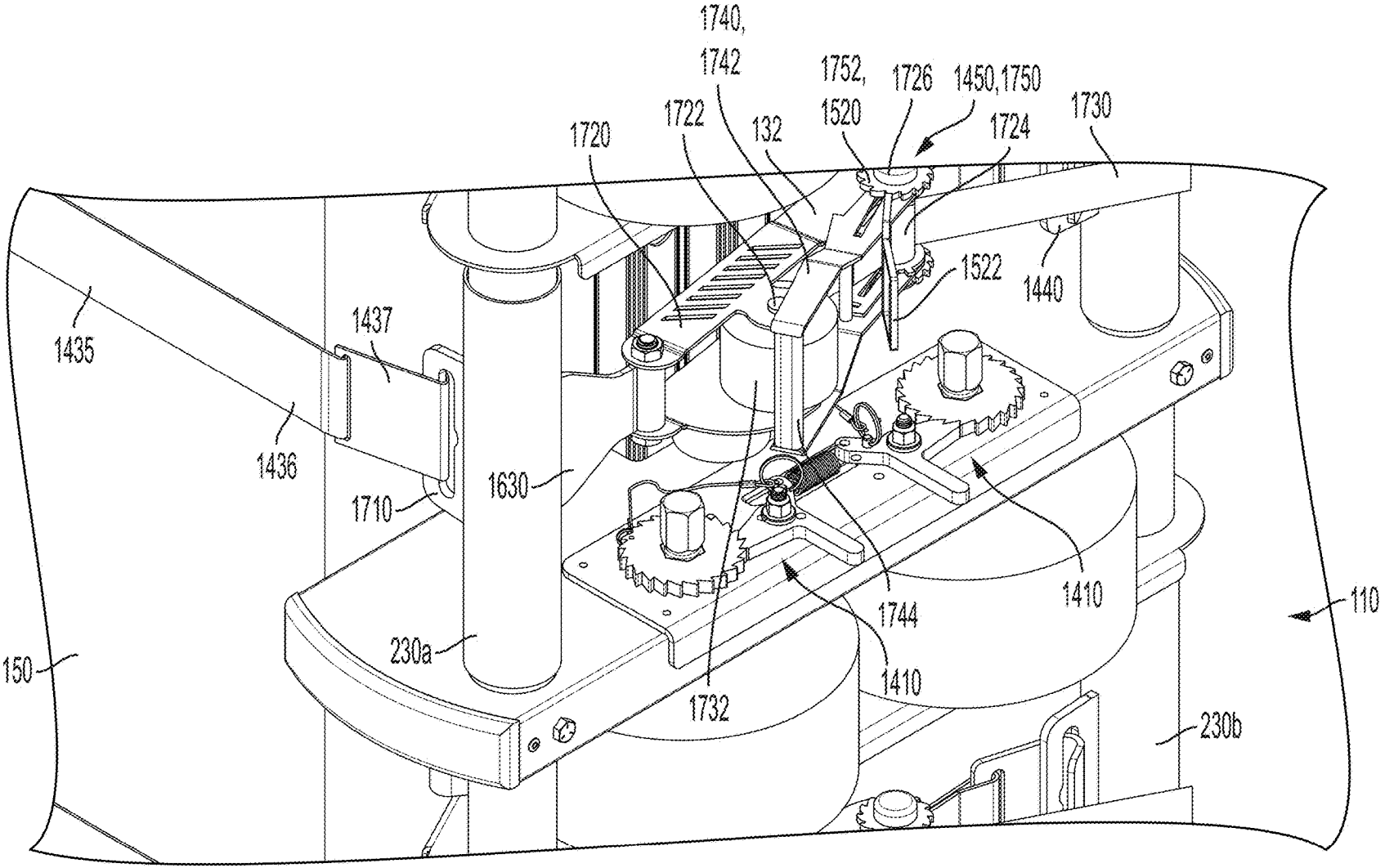
FIG. 17 is a front perspective view of the pillar attachment assembly of the guardrail post assembly of FIG. 14.

Referring to FIG. 17, the pillar attachment hook 1437 can be coupled to the free strap end 1436 of the pillar attachment strap 1435. In the un-extended configuration, the pillar attachment hook 1437 can removably engage the retaining bracket 1440, as previously described. In the extended configuration, the pillar attachment hook 1437 can be disengaged from the retaining bracket 1440 and the free strap end 1436 can be pulled away from the pillar attachment device 132 to unroll the pillar attachment strap 1435 and wrap the pillar attachment strap 1435 around the pillar 150. With the unrolled pillar attachment strap 1435 wrapped around the pillar 150, the pillar attachment hook 1437 can be hooked onto a strap attachment bracket 1710 of the guardrail post assembly 110 to secure the guardrail post assembly 110 to the pillar 150. In the present aspect, the strap attachment bracket 1710 can be coupled to the first mounting post 230*a*. In other aspects, the strap attachment bracket 1710 can be mounted elsewhere on the guardrail post assembly 110.

Example aspects of the pillar attachment device 132 can comprise an attachment frame 1720. The attachment frame 1720 can be mounted to the first mounting post 230*a* by the frame mounting bracket 1630. A first pillar strap mounting tube 1722 can be rotatably secured to the attachment frame 1720, and the pillar attachment strap 1435 can be rolled up around the first pillar strap mounting tube 1722, as shown. In the present aspect, each of the pillar attachment devices 132 can further comprise one of the pillar ratchet and pawl systems 1450. The pillar ratchet and pawl system 1450 can be similar to the guardrail ratchet and pawl system 1410 previously described, with some differences.

In the present aspect, the pillar ratchet and pawl system 1450 can be a ratchet strap system 1750 that can function similar to or the same as a standard ratchet strap system, as will be understood by one of ordinary skill in the art. For example, the pillar ratchet and pawl system 1450 can comprise a ratchet assembly 1752 comprising another one of the ratchets 1520 and a second pillar strap mounting tube 1724 and a crank assembly 1740 comprising another one of the pawls 1522. The second pillar strap mounting tube 1724 can be rotatably coupled to the attachment frame 1720. In example aspects, the pillar attachment strap 1435 can extend through a substantially vertical strap slot (not shown) formed through the second pillar strap mounting tube 1724. The ratchet 1520 can be fixedly mounted to a second upper tube end 1726 of the second pillar strap mounting tube 1724. The crank assembly 1740 can be movably coupled to the attachment frame 1720 and can be selectively reconfigured between a first position and a second position.

Example aspects of the crank assembly 1740 can comprise a crank body 1742 rotatably mounted to the attachment frame 1720 and the second pillar strap mounting tube 1724. The pawl 1522 can be coupled to the crank body 1742. Example aspects of the crank body 1742 can define a handle portion 1744 that can be manually gripped by a user to facilitate rotating the crank assembly 1740 between the first position and the second position. Rotation of the second pillar strap mounting tube 1724 can be prevented when the pawl 1522 is engaged with the ratchet 1520 in the engaged position.

To extend the pillar attachment strap 1435 around the pillar 150, the free strap end 1436 can be pulled away from the pillar attachment device 132 to unroll the pillar attachment strap 1435 from the first pillar strap mounting tube 1722 and draw the pillar attachment strap 1435 laterally through the strap slot of the second pillar strap mounting tube 1724. As previously described, the pillar attachment hook 1437 at the free strap end 1436 can then be hooked onto the strap attachment bracket 1710. The portion of the pillar attachment strap 1435 wrapped around the pillar 150 can be referred to as an extended section 1730 of the pillar attachment strap 1435, and the portion of the pillar attachment strap 1435 rolled up on the first pillar strap mounting tube 1722 can be referred to as a rolled section 1732 of the pillar attachment strap 1435.

To tension the pillar attachment strap 1435 once the extended section 1730 of the pillar attachment strap 1435 has been wrapped around the pillar 150 and connected to the strap attachment bracket 1710, the ratchet 1520 can be cranked in the winding direction to wind a portion of the extended section 1730 around the second pillar strap mounting tube 1724. To crank the ratchet 1520 in the winding direction, the crank assembly 1740 can initially be oriented to the first position. A user can grip the handle portion 1744 of the crank body 1742 and rotate the crank assembly 1740 to the second position. As the crank assembly 1740 is rotated to the closed position, the pawl 1522 can engage the ratchet 1520 and turn the ratchet 1520 in the winding direction. If the pillar attachment strap 1435 needs to be further tensioned, the crank assembly 1740 can once again be arranged in the first position and then rotated back to the second position to further crank the ratchet 1520 in the winding direction, and so on as needed. According to example aspects, a portion of the rolled section 1732 can be unrolled from the first pillar strap mounting tube 1722 and wrapped around the second pillar strap mounting tube 1724 as the ratchet 1520 and second pillar strap mounting tube 1724 are cranked in the winding direction.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A guardrail post assembly comprising:

a post frame defining a first lateral side and a second lateral side opposite the first lateral side;

a first guardrail strap mounted proximate to the first lateral side;

a second guardrail strap mounted proximate to the second lateral side, the first guardrail strap and the second guardrail strap mounted at equal heights on the guardrail post assembly; and a guardrail attachment assembly mounted to the post frame, the guardrail attachment assembly comprising a strap mounting portion and a locking portion, the first guardrail strap mounted on the strap mounting portion;

wherein:

the strap mounting portion further comprises a mounting tube;

the mounting tube is rotatable relative to and extends outward from an attachment housing of the post frame; and the first guardrail strap is mounted to the mounting tube of the strap mounting portion.

2. The guardrail post assembly of claim 1, wherein the first guardrail strap is a first upper guardrail strap and the second guardrail strap is a second upper guardrail strap, the guardrail post assembly further comprising:

a first lower guardrail strap mounted proximate to the first lateral side and below the first upper guardrail strap; and a second lower guardrail strap mounted proximate to the second lateral side and below the second lower guardrail strap, the first lower guardrail strap and the second lower guardrail strap mounted at equal heights on the guardrail post assembly.

3. The guardrail post assembly of claim 2, further comprising:

a first middle guardrail strap mounted proximate to the first lateral side and between the first upper guardrail strap and the first lower guardrail strap;

a second middle guardrail strap mounted proximate to the second lateral side and between the second upper guardrail strap and the second lower guardrail strap, the first middle guardrail strap and the second middle guardrail strap mounted at equal heights on the guardrail post assembly.

4. The guardrail post assembly of claim 1, wherein:

the post frame further comprises a mounting plate;

the locking portion is mounted on the attachment housing; and the first guardrail strap is mounted to the mounting tube between the attachment housing and the mounting plate.

5. The guardrail post assembly of claim 4, further comprising a substantially vertical spine post positioned about centrally between the first lateral side of the post frame and the second lateral side of the post frame, wherein the substantially vertical spine post extends between the attachment housing and the mounting plate to reinforce the guardrail post assembly.

6. The guardrail post assembly of claim 1, wherein the mounting tube defines an engagement opening at a tube end of the mounting tube, the engagement opening configured to be engaged by a tool to drive rotation of the strap mounting portion.

7. The guardrail post assembly of claim 1, wherein:

the strap mounting portion comprise a worm wheel;

the locking portion comprises a worm gear;

the guardrail post assembly is configurable in a disengaged configuration and an engaged configuration; and in the disengaged configuration, the worm gear is disengaged from the worm wheel, and in the engaged configuration, the worm gear is engaged with the worm wheel.

8. The guardrail post assembly of claim 7, wherein:

the post frame comprises a substantially vertical mounting post;

the attachment housing is coupled to the substantially vertical mounting post;

the worm wheel and the worm gear are substantially housed within the attachment housing; and the locking portion of the guardrail attachment assembly further comprises a compression spring biasing the worm gear to the disengaged configuration.

9. The guardrail post assembly of claim 8, wherein:

the locking portion of the guardrail attachment assembly further comprises a fastener plate and a first fastener;

the first fastener defines a first fastener end coupled to the worm gear and a second fastener end engaged with and slidable relative to the fastener plate; and the compression spring is mounted to the first fastener between the worm gear and the fastener plate.

10. The guardrail post assembly of claim 9, wherein:

the worm gear defines an unthreaded shaft portion and a threaded gear portion;

the threaded gear portion is coupled to the first fastener and arranged between the compression spring and the unthreaded shaft portion;

in the disengaged configuration, a first portion of the unthreaded shaft portion extends through an opening in the attachment housing and is arranged external to the attachment housing;

in the engaged configuration, the first portion of the unthreaded shaft portion is drawn into the attachment housing through the opening;

a stop flange extends from the unthreaded shaft portion opposite the threaded gear portion;

the stop flange is arranged external to the attachment housing; and a diameter of the stop flange is greater than a diameter of the opening in the attachment housing to prohibit the stop flange from passing through the opening.

11. The guardrail post assembly of claim 1, wherein:

the strap mounting portion comprises a ratchet fixedly attached to the mounting tube;

the first guardrail strap is rolled up on the mounting tube; and the locking portion comprises a pawl biased into engagement with the ratchet.

12. The guardrail post assembly of claim 11, wherein:

the locking portion further comprises a pawl spring biasing the pawl into engagement with the ratchet in an engaged position;

the strap mounting portion is configured to rotate in a winding direction and an unwinding direction; and in the engaged position, the pawl prohibits the ratchet from rotating in the unwinding direction.

13. The guardrail post assembly of claim 12, wherein:

the pawl is movable from the engaged position to a disengaged position;

in the disengaged position, the ratchet is permitted to rotate in the unwinding direction; and a locking pin selectively secures the pawl in the engaged position.

14. The guardrail post assembly of claim 12, wherein:

the ratchet defines a plurality of ratchet teeth; and the ratchet teeth are canted to allow the ratchet to rotate in the winding direction with the pawl in the engaged position.

15. The guardrail post assembly of claim 1, wherein:

a first wheel bracket is arranged at the first lateral side and a second wheel bracket is arranged at the second lateral side; and a first wheel is mounted to the first wheel bracket and a second wheel is mounted to the second wheel bracket to permit the guardrail post assembly to be rolled across a support surface.

16. A guardrail post assembly comprising:

a post frame comprising a substantially vertical mounting post;

a pillar attachment assembly comprising:

a pillar attachment chain configured to wrap around a pillar; and a pillar attachment device mounted to the substantially vertical mounting post, the pillar attachment device comprising a chain attachment bracket and a bracket fastener threadedly engaging the chain attachment bracket, wherein the bracket fastener is rotatable relative to the chain attachment bracket to selectively tighten or loosen the pillar attachment chain around the pillar;

a guardrail attachment assembly mounted to the post frame; and a guardrail strap mounted to the guardrail attachment assembly;

wherein:

the chain attachment bracket defines a fastener opening;

a threaded nut is mounted within the fastener opening; and a threaded shaft of the bracket fastener threadedly engages the threaded nut.

17. The guardrail post assembly of claim 16, wherein:

the pillar attachment device further comprises a post mounting bracket coupling the pillar attachment device to the post frame;

the post mounting bracket comprises a mounting portion and a fastener sleeve;

the mounting portion engages the substantially vertical mounting post; and the threaded shaft of the bracket fastener extends through the fastener sleeve.

18. The guardrail post assembly of claim 17, wherein the chain attachment bracket defines a chain slot, and wherein the pillar attachment chain is received through the chain slot.

19. The guardrail post assembly of claim 18, wherein:

the chain slot defines a wide portion and a narrow portion;

the pillar attachment chain comprises a plurality of chain links; and one of the plurality of chain links is received in the narrow portion of the chain slot to prohibit the pillar attachment chain to prohibit adjacent ones of the plurality of chain links from passing through the chain slot.

20. The guardrail post assembly of claim 17, wherein:

the chain attachment bracket defines an adjustment slot;

the adjustment slot slidably receives the mounting portion of the post mounting bracket; and the chain attachment bracket is drawn towards and away from the post mounting bracket as the pillar attachment chain is selectively tightened or loosened by the bracket fastener.

21. The guardrail post assembly of claim 16, wherein:
the post frame further comprises a substantially vertical spine post for reinforcing the guardrail post assembly;
the spine post defines a storage opening allowing access to a hollow interior of the spine post; and
an excess length of the pillar attachment chain is received through the storage opening in the hollow interior when the guardrail post assembly is not in use.

22. The guardrail post assembly of claim 16, wherein:
the substantially vertical mounting post is a substantially vertical first mounting post;
the post frame comprises a substantially vertical second mounting post;
the pillar attachment assembly is a first pillar attachment assembly coupled to a first chain end of the pillar attachment chain; and
the guardrail post assembly comprises a second pillar attachment assembly mounted to the substantially vertical second mounting post and coupled to a second chain end of the pillar attachment chain, opposite the first chain end.

23. A guardrail post assembly comprising:
a post frame;
a ratchet strap system mounted to the post frame and configured to couple the post frame to a first pillar, the ratchet strap system comprising:
a pillar attachment strap configured to wrap around the first pillar;
a ratchet assembly comprising a ratchet and a mounting tube; and
a crank assembly comprising a pawl, wherein the pawl engages the ratchet to crank the ratchet in a winding direction, and wherein the pillar attachment strap is wound up on the mounting tube as the ratchet is cranked in the winding direction to tension the pillar attachment strap around the first pillar; and
a first guardrail strap mounted to the post frame and configured to extend between the first pillar and a second pillar.

24. The guardrail post assembly of claim 23, wherein the crank assembly comprises a crank body rotatably mounted to the ratchet assembly, and wherein the pawl is coupled to the crank body.

25. The guardrail post assembly of claim 24, wherein the crank body defines a handle portion, and wherein the handle portion is configured to be gripped by a user to facilitate rotating the crank assembly between a first position and a second position.

26. The guardrail post assembly of claim 23, wherein:
the guardrail post assembly further comprises:
an attachment frame coupling the ratchet strap system to the post frame; and
a second mounting tube rotatably coupled to the attachment frame; and
the pillar attachment strap is wound up on the second mounting tube.

27. The guardrail post assembly of claim 23, wherein:
the pillar attachment strap defines a free strap end;
the free strap end is connected to a pillar attachment hook;
a strap attachment bracket is mounted to the post frame; and
the pillar attachment hook engages the strap attachment bracket to secure the pillar attachment strap around the first pillar.

28. A guardrail post assembly comprising:
a post frame defining a first lateral side and a second lateral side opposite the first lateral side;
a first guardrail strap mounted proximate to the first lateral side;
a second guardrail strap mounted proximate to the second lateral side, the first guardrail strap and the second guardrail strap mounted at equal heights on the guardrail post assembly; and
a guardrail attachment assembly mounted to the post frame, the guardrail attachment assembly comprising a strap mounting portion and a locking portion, the first guardrail strap mounted on the strap mounting portion;
wherein:
the strap mounting portion comprises a worm wheel;
the locking portion comprises a worm gear;
the guardrail post assembly is configurable in a disengaged configuration and an engaged configuration; and
in the disengaged configuration, the worm gear is disengaged from the worm wheel, and in the engaged configuration, the worm gear is engaged with the worm wheel.

29. The guardrail post assembly of claim 28, wherein:
the post frame comprises a substantially vertical mounting post;
the attachment housing is coupled to the substantially vertical mounting post;
the worm wheel and the worm gear are substantially housed within the attachment housing; and
the locking portion of the guardrail attachment assembly further comprises a compression spring biasing the worm gear to the disengaged configuration.

30. The guardrail post assembly of claim 29, wherein:
the locking portion of the guardrail attachment assembly further comprises a fastener plate and a first fastener;
the first fastener defines a first fastener end coupled to the worm gear and a second fastener end engaged with and slidable relative to the fastener plate; and
the compression spring is mounted to the first fastener between the worm gear and the fastener plate.

31. The guardrail post assembly of claim 30, wherein:
the worm gear defines an unthreaded shaft portion and a threaded gear portion;
the threaded gear portion is coupled to the first fastener and arranged between the compression spring and the unthreaded shaft portion;
in the disengaged configuration, a first portion of the unthreaded shaft portion extends through an opening in the attachment housing and is arranged external to the attachment housing;
in the engaged configuration, the first portion of the unthreaded shaft portion is drawn into the attachment housing through the opening;
a stop flange extends from the unthreaded shaft portion opposite the threaded gear portion;
the stop flange is arranged external to the attachment housing; and
a diameter of the stop flange is greater than a diameter of the opening in the attachment housing to prohibit the stop flange from passing through the opening.

32. A guardrail post assembly comprising:
a post frame defining a first lateral side and a second lateral side opposite the first lateral side;
a first guardrail strap mounted proximate to the first lateral side;
a second guardrail strap mounted proximate to the second lateral side, the first guardrail strap and the second guardrail strap mounted at equal heights on the guardrail post assembly; and a guardrail attachment assembly mounted to the post frame, the guardrail attachment assembly comprising a strap mounting portion and a locking portion, the first guardrail strap mounted on the strap mounting portion;

wherein:

the strap mounting portion comprises a mounting tube and a ratchet fixedly attached to the mounting tube;

the first guardrail strap is rolled up on the mounting tube; and the locking portion comprises a pawl biased into engagement with the ratchet.

33. The guardrail post assembly of claim 32, wherein:

the locking portion further comprises a pawl spring biasing the pawl into engagement with the ratchet in an engaged position;

the strap mounting portion is configured to rotate in a winding direction and an unwinding direction; and in the engaged position, the pawl prohibits the ratchet from rotating in the unwinding direction.

34. The guardrail post assembly of claim 33, wherein:

the pawl is movable from the engaged position to a disengaged position;

in the disengaged position, the ratchet is permitted to rotate in the unwinding direction; and a locking pin selectively secures the pawl in the engaged position.

35. The guardrail post assembly of claim 33, wherein:

the ratchet defines a plurality of ratchet teeth; and the ratchet teeth are canted to allow the ratchet to rotate in the winding direction with the pawl in the engaged position.

36. A guardrail post assembly comprising:

a post frame defining a first lateral side and a second lateral side opposite the first lateral side;

a first guardrail strap mounted proximate to the first lateral side;

a second guardrail strap mounted proximate to the second lateral side, the first guardrail strap and the second guardrail strap mounted at equal heights on the guardrail post assembly; and a guardrail attachment assembly mounted to the post frame, the guardrail attachment assembly comprising a strap mounting portion and a locking portion, the first guardrail strap mounted on the strap mounting portion;

wherein:

a first wheel bracket is arranged at the first lateral side and a second wheel bracket is arranged at the second lateral side; and a first wheel is mounted to the first wheel bracket and a second wheel is mounted to the second wheel bracket to permit the guardrail post assembly to be rolled across a support surface.

37. A guardrail post assembly comprising:

a post frame comprising a substantially vertical mounting post;

a pillar attachment assembly comprising:

a pillar attachment chain configured to wrap around a pillar; and a pillar attachment device mounted to the substantially vertical mounting post, the pillar attachment device comprising a chain attachment bracket and a bracket fastener threadedly engaging the chain attachment bracket, wherein the bracket fastener is rotatable relative to the chain attachment bracket to selectively tighten or loosen the pillar attachment chain around the pillar;

a guardrail attachment assembly mounted to the post frame; and a guardrail strap mounted to the guardrail attachment assembly;

wherein:

the post frame further comprises a substantially vertical spine post for reinforcing the guardrail post assembly;

the spine post defines a storage opening allowing access to a hollow interior of the spine post; and an excess length of the pillar attachment chain is received through the storage opening in the hollow interior when the guardrail post assembly is not in use.

38. A guardrail post assembly comprising:

a post frame comprising a substantially vertical mounting post;

a pillar attachment assembly comprising:

a pillar attachment chain configured to wrap around a pillar; and a pillar attachment device mounted to the substantially vertical mounting post, the pillar attachment device comprising a chain attachment bracket and a bracket fastener threadedly engaging the chain attachment bracket, wherein the bracket fastener is rotatable relative to the chain attachment bracket to selectively tighten or loosen the pillar attachment chain around the pillar;

a guardrail attachment assembly mounted to the post frame; and a guardrail strap mounted to the guardrail attachment assembly;

wherein:

the substantially vertical mounting post is a substantially vertical first mounting post;

the post frame comprises a substantially vertical second mounting post;

the pillar attachment assembly is a first pillar attachment assembly coupled to a first chain end of the pillar attachment chain; and the guardrail post assembly comprises a second pillar attachment assembly mounted to the substantially vertical second mounting post and coupled to a second chain end of the pillar attachment chain, opposite the first chain end.

* * * * *